US011136852B2

(12) United States Patent
Branton

(10) Patent No.: US 11,136,852 B2
(45) Date of Patent: Oct. 5, 2021

(54) DOWNHOLE BRIDGE PLUG SEALING ELEMENT SYSTEMS

(71) Applicant: Christopher A. Branton, Bossier, LA (US)

(72) Inventor: Christopher A. Branton, Bossier, LA (US)

( * ) Notice: Subject to any disclaimer, the term of this patent is extended or adjusted under 35 U.S.C. 154(b) by 51 days.

(21) Appl. No.: 16/243,785

(22) Filed: Jan. 9, 2019

(65) Prior Publication Data

US 2020/0217172 A1 Jul. 9, 2020

(51) Int. Cl.

| | |
|---|---|
| ***E21B 33/12*** | (2006.01) |
| ***E21B 33/128*** | (2006.01) |
| ***E21B 33/129*** | (2006.01) |

(52) U.S. Cl.

CPC ..... *E21B 33/1216* (2013.01); *E21B 33/128* (2013.01); *E21B 33/1293* (2013.01)

(58) Field of Classification Search

CPC . E21B 33/1216; E21B 33/1293; E21B 33/128
See application file for complete search history.

(56) References Cited

U.S. PATENT DOCUMENTS

| | | | |
|---|---|---|---|
| 2,809,080 | A | 10/1957 | Mittell et al. |
| 3,298,440 | A | 1/1967 | Current |
| 4,491,178 | A | 1/1985 | Terrell et al. |
| 7,290,603 | B2 | 11/2007 | Hiorth et al. |
| 7,424,909 | B2 | 9/2008 | Roberts et al. |
| 7,762,323 | B2 | 7/2010 | Frazier |
| 7,980,300 | B2 | 7/2011 | Roberts et al. |
| 8,016,295 | B2 | 9/2011 | Guest et al. |
| 8,205,671 | B1 | 6/2012 | Branton |
| 9,260,936 | B1 | 2/2016 | Branton |
| 2009/0126925 | A1 | 5/2009 | Guest et al. |
| 2011/0024134 | A1* | 2/2011 | Buckner ..... E21B 33/1204 166/382 |

(Continued)

*Primary Examiner* — Dany E Akakpo
(74) *Attorney, Agent, or Firm* — R. Keith Harrison

(57) ABSTRACT

Sealing element system for a downhole bridge plug assembly may include a packer mandrel. At least one sealing element may be carried by the packer mandrel. A first completion ring may be carried by the packer mandrel on a first side of the at least one sealing element. The first completion ring may have a first beveled outer completion ring surface. A second completion ring may be carried by the packer mandrel on a second side of the at least one sealing element. The second completion ring may have a second beveled outer completion ring surface. A first backup ring support may be carried by the packer mandrel proximate the first completion ring. A second backup ring support may be carried by the packer mandrel proximate the second completion ring. A first backup ring may be carried by the first backup ring support. The first backup ring may include a circumferentially-expandable first backup ring body. A first ring sleeve may extend from the first backup ring body. A second backup ring may be carried by the second backup ring support. The second backup ring may include a circumferentially-expandable second backup ring body. A second ring sleeve may extend from the second backup ring body. Backup rings for a sealing element system for a downhole bridge plug assembly are also disclosed.

16 Claims, 20 Drawing Sheets

(56) References Cited

U.S. PATENT DOCUMENTS

2012/0061105 A1* 3/2012 Neer ..... E21B 33/1216
166/387
2013/0192853 A1 8/2013 Themig

* cited by examiner

DOWNHOLE BRIDGE PLUG SEALING ELEMENT SYSTEMS

FIELD

Illustrative embodiments of the disclosure generally relate to downhole bridge plugs or packers for selectively plugging a subterranean well for well operations. More particularly, illustrative embodiments of the present disclosure relate to downhole bridge plug sealing element systems having enhanced well fluid sealing characteristics.

BACKGROUND

The background description provided herein is solely for the purpose of generally presenting the context of the illustrative embodiments of the disclosure. Aspects of the background description are neither expressly nor impliedly admitted as prior art against the claimed subject matter.

In the production of fluids such as hydrocarbons from a subterranean well, it may be desirable to selectively seal or plug the well at various locations. For example, in hydrocarbon (oil and/or gas) production wells, it may be necessary or desirable to seal off a lower hydrocarbon-producing formation during the extraction of hydrocarbons from an upper hydrocarbon-producing formation. In other applications, it may be necessary or desirable to isolate the bottom of the well from the wellhead.

Downhole bridge plug sealing element systems having enhanced well fluid sealing characteristics may be desirable for some applications.

SUMMARY

Illustrative embodiments of the disclosure are generally directed to sealing element systems for a downhole bridge plug assembly. An illustrative embodiment of the sealing element systems may include a packer mandrel. At least one sealing element may be carried by the packer mandrel. A first completion ring may be carried by the packer mandrel on a first side of the at least one sealing element. The first completion ring may have a first beveled outer completion ring surface. A second completion ring may be carried by the packer mandrel on a second side of the at least one sealing element. The second completion ring may have a second beveled outer completion ring surface. A first backup ring support may be carried by the packer mandrel proximate the first completion ring. A second backup ring support may be carried by the packer mandrel proximate the second completion, ring. A first backup ring may be carried by the first backup ring support. The first backup ring may include a circumferentially-expandable first backup ring body. A first ring sleeve may extend from the first backup ring body. A second backup ring may be carried by the second backup ring support. The second backup ring may include a circumferentially-expandable second backup ring body. A second ring sleeve may extend from the second backup ring body.

Illustrative embodiments of the disclosure are further generally directed, to backup rings for a sealing element system for a downhole bridge plug assembly. An illustrative embodiment of the backup rings may include a circumferentially-expandable backup ring body having an engaging ring surface. A beveled ring surface may extend from the engaging ring surface. An interior ring surface may extend from the beveled ring surface to the engaging ring surface. A ring opening may be formed by the beveled ring surface.

A plurality of spiral ring slots may extend through the backup ring body from the engaging ring surface to the beveled ring surface. A plurality of expandable ring, portions may extend between the plurality of spiral ring slots. An at least partially circumferentially-expanding ring sleeve may extend from the backup ring body. In some embodiments, an outer width or diameter of the ring sleeve may correspond to an outer width or diameter of the backup ring body. The ring sleeve may include a ring sleeve wall extending from the interior ring surface of the backup ring body. A sleeve interior may be formed by the ring sleeve wall. A plurality of sleeve slots may extend through the ring sleeve wall. The plurality of sleeve slots may communicate with the plurality of spiral ring slots, respectively, in the backup ring body. A plurality of expandable sleeve portions may extend between the plurality of sleeve slots. The plurality of expand able sleeve portions may extend from the plurality of expandable ring portions of the backup ring body.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be hound by any expressed or implied theory presented in the preceding technical field, background, brief summary or the following detailed description. As used herein, relative terms such as "upper" and "lower" are intended to be used in an illustrative and not a limiting sense. In some applications, therefore, those elements which, are identified as "upper" may be located beneath those elements which are identified as "lower" in the following detailed description. As used herein, the terms "upper" and "proximal" are intended to denote the end of a component which is closer to the well surface and the terms "lower" and "distal" are intended to denote the end of a component which is farther from the well surface.

Figure 1:
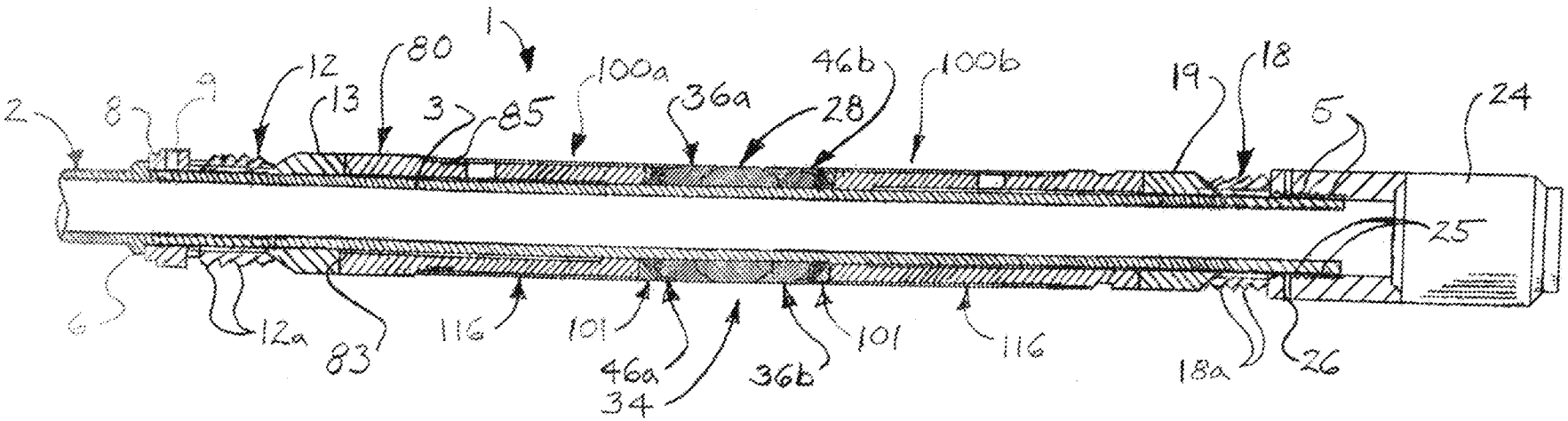
FIG. 1 is a longitudinal sectional view of an illustrative embodiment of the downhole bridge plug sealing element systems, assembled in a typical downhole bridge plug assembly and deployed in a pre-expanded, pre-sealing configuration.
Figure 2:
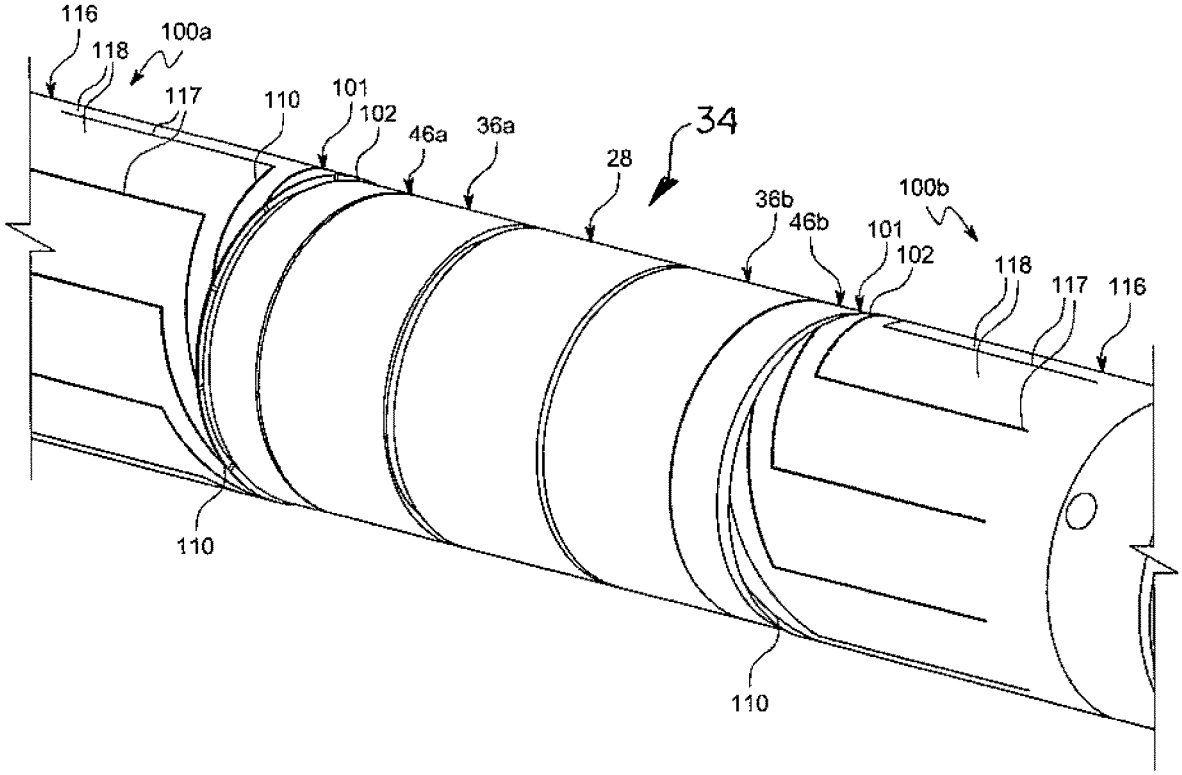
FIG. 2 is a perspective view, partially in section, of the illustrative pre-expanded sealing element system.
Figure 3:
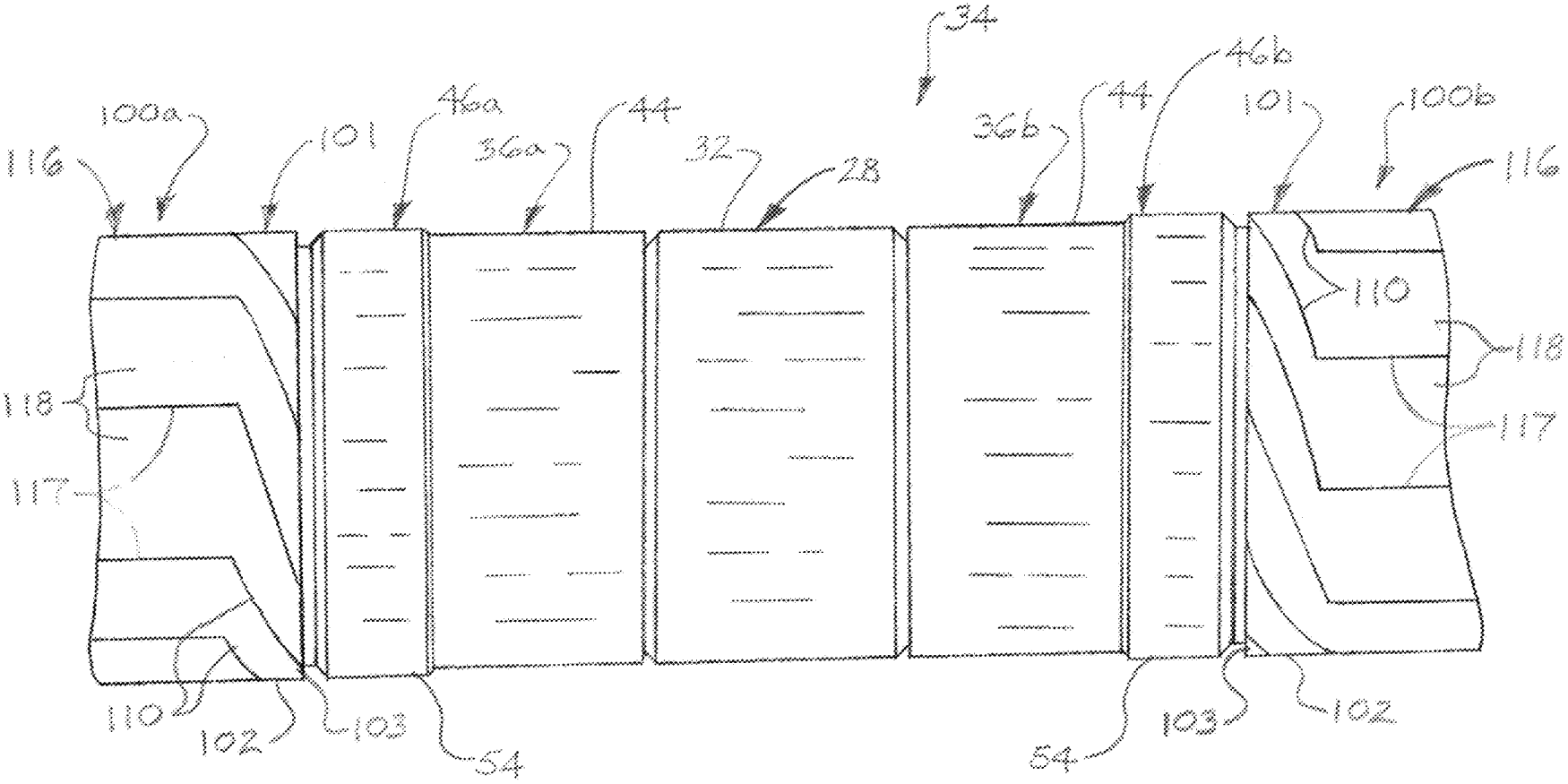
FIG. 3 is an exterior view of the illustrative pre-expanded sealing element system.
Figure 4:
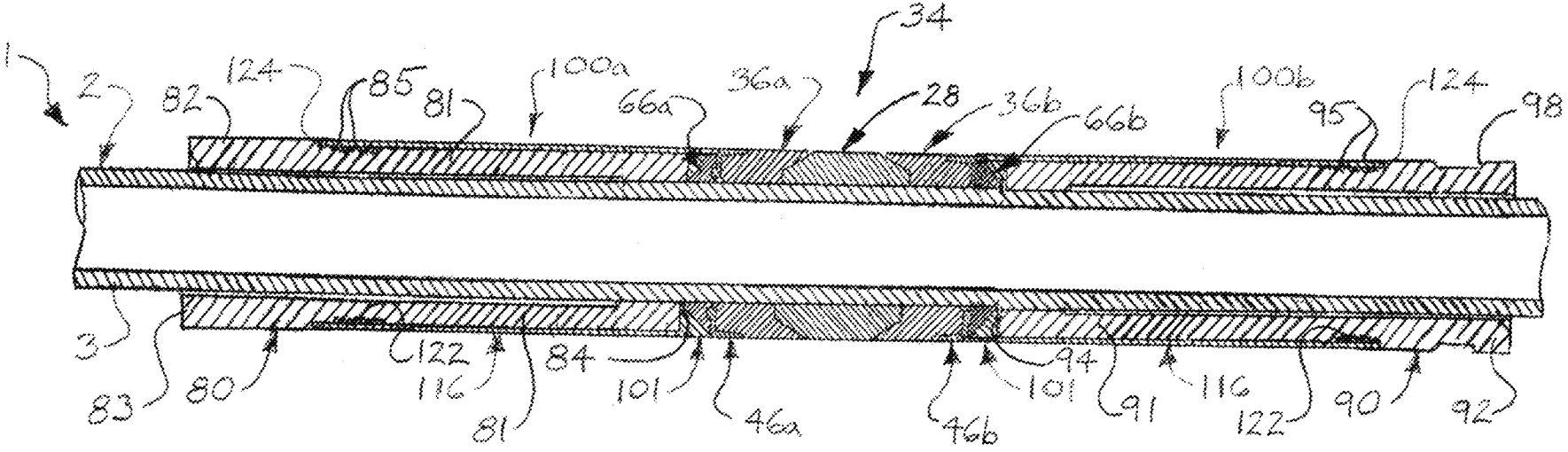
FIG. 4 is a longitudinal sectional view of the illustrative pre-expanded sealing element system.

Referring initially to FIGS. 1-5 of the drawings, an illustrative embodiment of the downhole bridge plug sealing element systems, hereinafter sealing element system, is generally indicated by reference numeral 34. In some applications, the sealing element system 34 may be assembled in a drillable downhole bridge plug assembly or packer assembly, hereinafter assembly 1. As illustrated in FIGS. 1 and 4, the assembly 1 may include a packer mandrel 2 which in some embodiments may have any suitable type of rigid drillable material including but not limited to metal, composite material and/or engineering-grade plastic. The packer mandrel 2 may have a generally elongated, cylindrical packer mandrel wall 3. As illustrated in FIG. 1, a mandrel flange 6 may protrude from the exterior surface of the packer mandrel wall 3 at a first end of the packer mandrel 2. Ratchet threads 5 may be provided on the exterior surface of the packer mandrel wall 3 at a second end of the packer mandrel 2. As further illustrated in FIG. 1, a packer mandrel cap 8 may have a cap pin opening 9 through which a cap pin (not illustrated) may be extended to pin the packer mandrel cap 8 to the packer mandrel 2. A compression sleeve 24 may have interior sleeve threads 25 which engage the ratchet threads 5 on the packer mandrel 2. The compression sleeve 24 may be provided on an upper tubing string segment 134 (FIG. 42) of a tubing string 138 to facilitate placement of the assembly 1 in a well casing 130 in use of the assembly 1, which will be hereinafter described. In some embodiments, shear pins (not illustrated) may be extended through registering, shear pin openings 26 (FIG. 1) provided in the compression sleeve 24 and the packer mandrel wall 3 to facilitate attachment of the compression sleeve 24 to the packer mandrel 2.

As further illustrated in FIG. 1, a lower pressure-applying element such as an annular lower slip assembly 12 having multiple slip assembly ridges 12*a* may be provided on the packer mandrel 2 typically adjacent to the packer mandrel cap 8. An upper pressure-applying element such as an annular upper slip assembly 18 having multiple slip assembly ridges 18*a* may be provided on the packer mandrel 2 generally adjacent to the compression sleeve 24. An annular lower cone 13 may be provided on the packer mandrel 2 in engagement with the lower slip assembly 12. An annular upper cone 19 may be provided on the packer mandrel 2 in engagement with the upper slip assembly 8.

Figure 5:
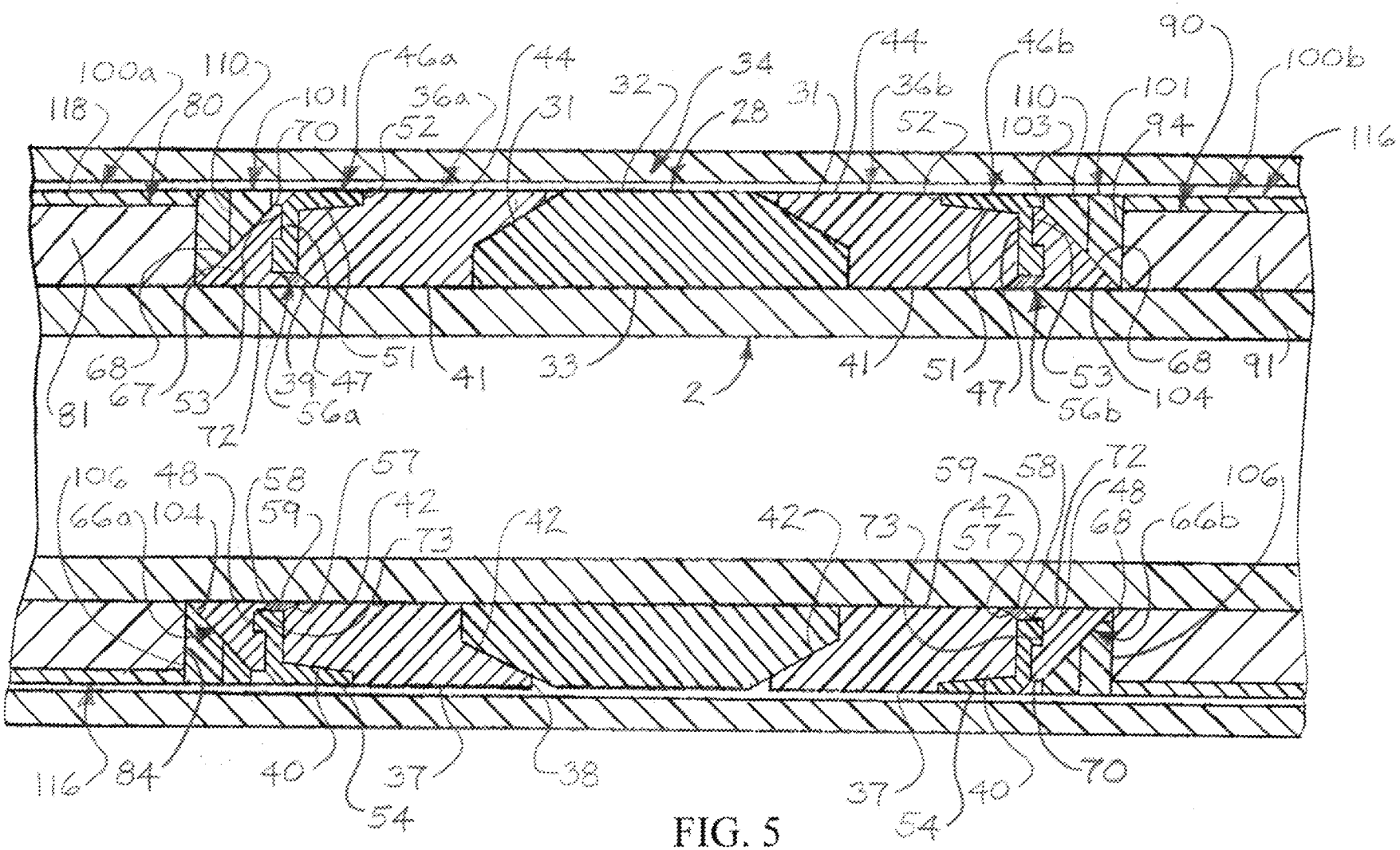
FIG. 5 is an enlarged sectional view of the illustrative pre-expanded sealing element system, deployed in a well casing in typical application of the sealing element system.
Figure 7:
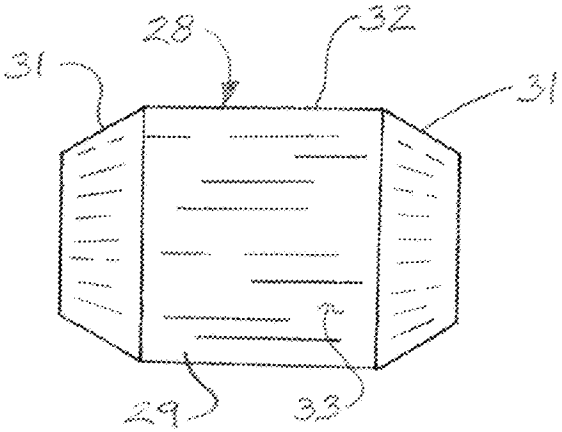
FIG. 7 is an exterior view of the center sealing element.

The sealing element system 34 may be assembled on the packer mandrel 2 typically between the lower cone 13 and the upper cone 19. The sealing element system 34 may include a circumferentially-expandable center sealing element 28. A circumferentially-expandable lower end sealing element 36*a* and a circumferentially-expandable upper end sealing element 36*b* may engage the center sealing element 28. A lower sealing element support ring 46*a* and an upper sealing element support ring 46*b* may engage the respective lower end sealing element 36*a* and upper end sealing element 36*b*. As illustrated in FIG. 5, a lower end element seal ring 56*a* and an upper end element seal ring 56*b* may engage the end sealing element bevels 39 of the respective lower end sealing element 36*a* and upper end sealing element 36*b* and may be interposed between the packer mandrel 2 and the respective lower sealing element support ring 46*a* and upper sealing element support ring 46*b*. A lower completion ring 66*a* and an upper completion ring 66*b* may engage the respective lower sealing element support ring 46*a* and upper seating element support ring 46*b*, and the completion ring rims 71 may engage the respective lower end element seal ring 56*a* and upper end element seal ring 56*b*. A lower backup ring 100*a* and an upper backup ring 100*b* may engage the respective lower completion ring 66*a* and upper completion ring 66*b*. In some embodiments, a lower backup ring support 80 may be provided on the packer mandrel 2 in engagement with the lower cone 13. The lower backup ring 100*a* may be provided on the lower backup ring support 80. An upper backup ring support 90 may be provided on the packer mandrel 2 in engagement with the upper cone 19. The upper backup ring 100*b* may be provided on the upper backup ring support 90. The structure of the center sealing element 28, the end sealing elements 36, the sealing element support rings 46, the end element seal rings 56, the completion rings 66, the backup rings 100, the lower backup ring support 80 and the upper backup ring support 90 will be hereinafter described.

As used herein, "inner" denotes the end or surface of an element or component which is closest or proximate to the center sealing element 28 of the sealing element system 34, whereas "outer" denotes the end or surface of an element or component which is farther from the center sealing element 28 of the sealing element system 34.

Preferring next to FIGS. 41-43 of the drawings, in typical operation of the sealing element system 34, which will be hereinafter further described, the assembly 1 may be assembled in a tubing string 138 and inserted into a downhole well casing 1300. The sealing element system 34, as well as the lower slip assembly 12, lower cone 13, upper slip, assembly 18 and upper Cone 19, may initially be deployed in the pre-expanded configuration illustrated in FIG. 41. Accordingly, well fluid (not illustrated) can flow through an annular space 132 between the assembly 1 and the interior surface of the well casing 130. The sealing element system 34, lower slip assembly 12, lower cone 13, upper slip assembly 18 and upper cone 19 can be selectively deployed from the pre-expanded configuration to the fluid-sealing, expanded configuration illustrated in FIGS. 42 and 43 to close the annular space 132 and fluidly seal adjacent segments of the tubing string 138 for any of various purposes.

Referring next to FIGS. 6-9 of the drawings, a typical design for the center sealing element 28 of the sealing element system 34 is illustrated. The center sealing element 28 may have a center sealing element wall 29. The center sealing element wall 29 may include a center sealing element middle portion 32 which may be cylindrical. The center sealing element middle portion 32 may have a center sealing element exterior surface 33.

Figure 9:
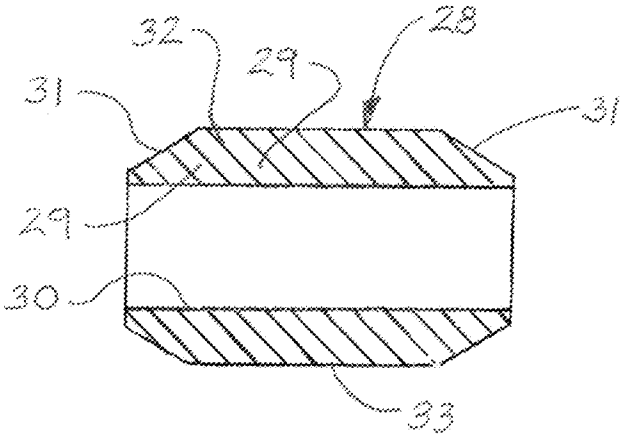
FIG. 9 is a longitudinal sectional view of the center sealing element.
Figure 6:
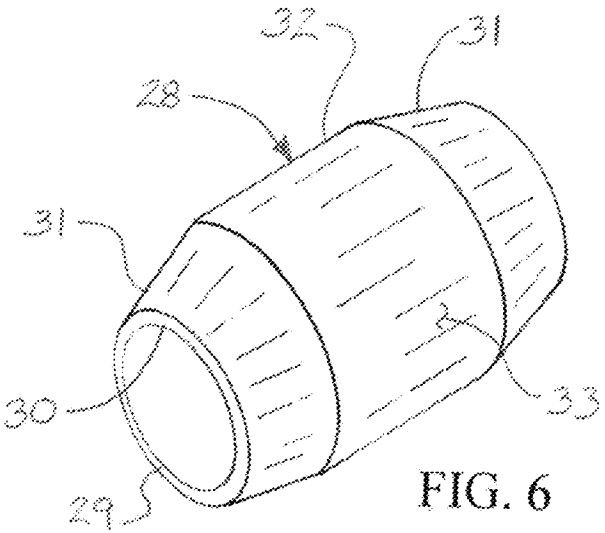
FIG. 6 is a perspective view of a typical center sealing element of the illustrative sealing element system.
Figure 8:
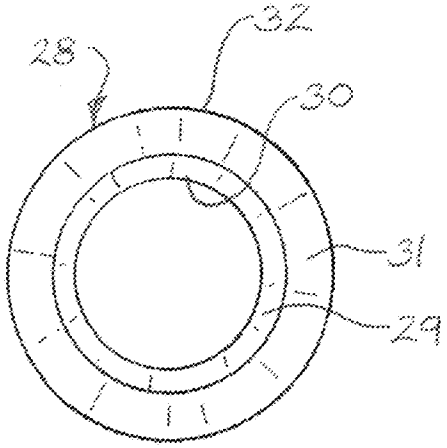
FIG. 8 is an end view of the center sealing element.

A pair of center sealing element beveled portions 31 may angle from opposite ends of the center sealing element middle portion 32. As illustrated in FIGS. 8 and 9, a center sealing element bore 30 may traverse the center seal ng element beveled portions 31 and the center sealing element middle portion 32. In some embodiments, the center sealing element 28 may be fabricated of a suitable type of rigid drillable material including but not limited to rubber.

Figure 11:
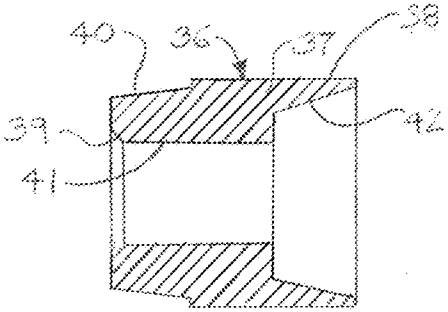
FIG. 11 is a longitudinal sectional view of the end sealing element.
Figure 12:
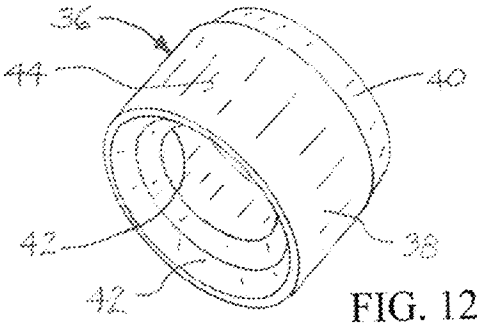
FIG. 12 is an inner perspective view of the end sealing element.
Figure 14:
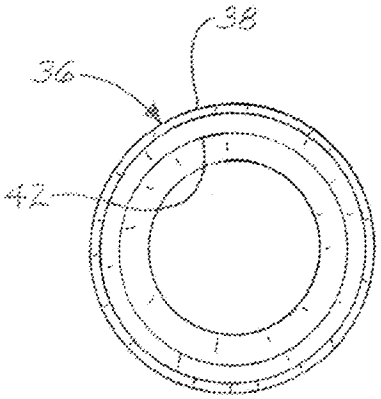
FIG. 14 is an inner end view of the end sealing element.
Figure 10:
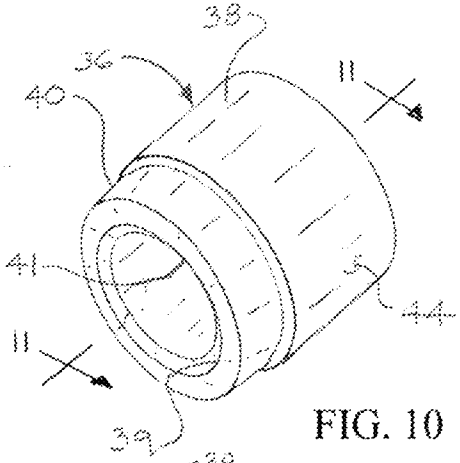
FIG. 10 is an outer perspective view of a typical end scaling element of the illustrative sealing element system.
Figure 13:
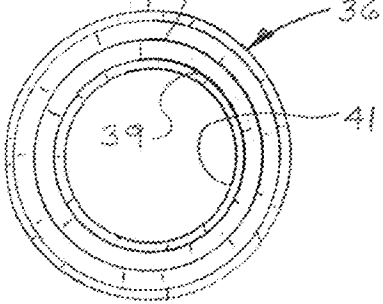
FIG. 13 is an outer end view of the end sealing element.
Figure 16:
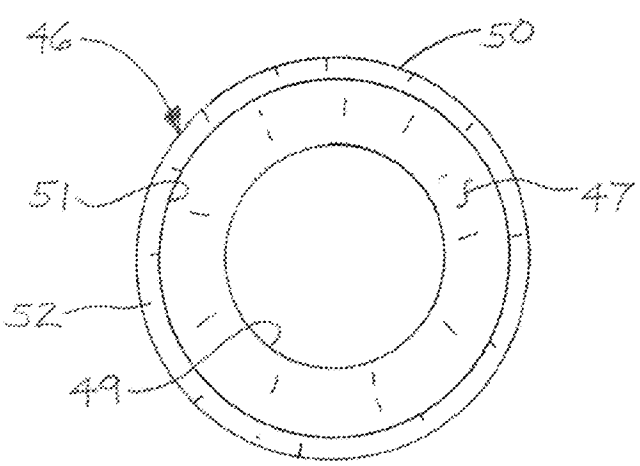
FIG. 16 is an inner end view of the scaling element support ring.
Figure 18:
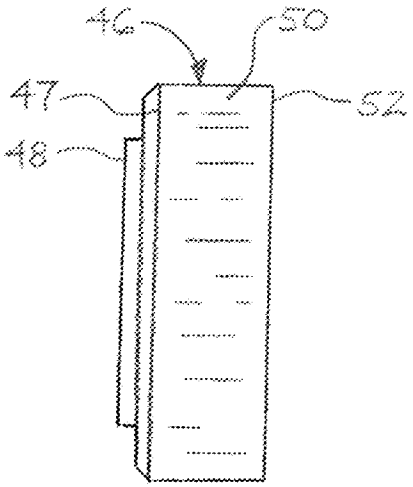
FIG. 18 is an exterior view of the sealing element support ring.
Figure 15:
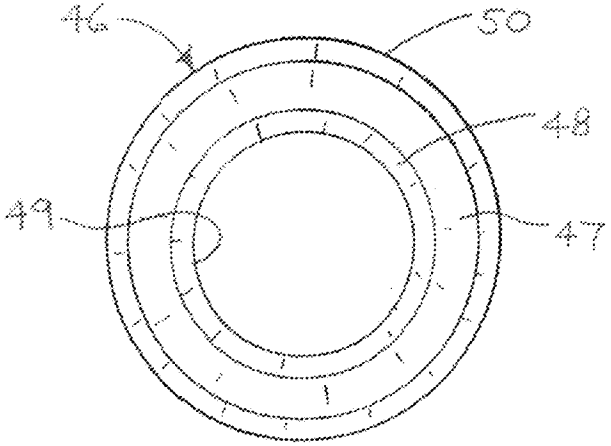
FIG. 15 is an outer end view of a typical sealing element support ring of the illustrative sealing element system.
Figure 17:
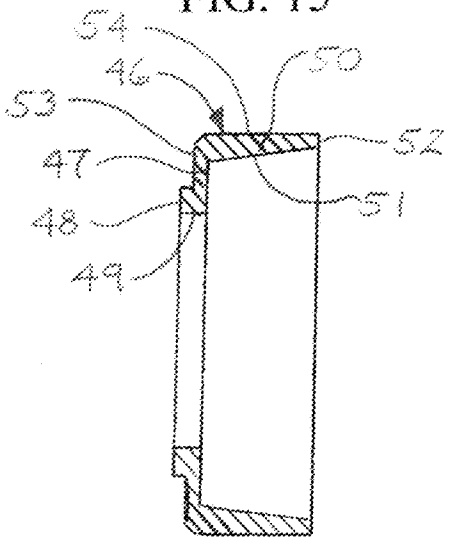
FIG. 17 is a cross-sectional view of the sealing element support ring.
Figure 20:
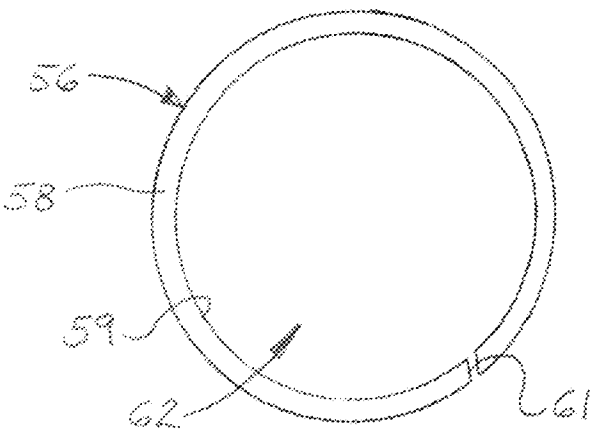
FIG. 20 is an outer view of the end element seal ring.

Referring next to FIGS. 10-14, a typical design for each end sealing element 36 of the sealing element system 34 is illustrated. Each end sealing element 36 may have an end sealing element wall 37. The end sealing element wall 37 may include an end sealing element main portion 38 which may be cylindrical. As illustrated in FIG. 11, an end sealing element cavity 42 may extend into the end sealing element main portion 38. In some embodiments, the end sealing element cavity 42 may have a beveled, tapered or angled cross-section. The end sealing element main portion 38 may have an end sealing element exterior surface 44.

An end sealing element beveled portion 40 may extend from the end sealing element main portion 38. As illustrated in FIG. 11, an end sealing element bore 41 may traverse the end sealing element beveled portion 40 and may extend into the end sealing element main portion 38 and communicate with the end sealing element cavity 42. An annular end sealing element bevel 39 may be provided at the end of the end sealing element bore 41 which is opposite the end sealing element cavity 42. In some embodiments, each end sealing element 36 may be fabricated of a suitable type of rigid drillable material including but not limited to metal, composite material and/or engineering-grade plastic. Materials which are suitable for the end sealing element 36 include but are not limited to rubber.

Referring next to FIGS. 15-18 of the drawings, a typical design for each scaling element support ring 46 of the scaling element system 34 is illustrated. Each sealing element support ring 46 may have a support ring wall 47. A wall rim 48 may protrude from the support ring, wall 47. A rim opening 49 may extend through the wall rim 48.

A support ring extension 50 having an inner support ring edge 52 may extend from the support ring wall 47. The support ring extension 50 may have an exterior support ring surface 54 and a support ring interior 51 which communicates with the rim opening 49 of the wall rim 48. In some embodiments, the support ring interior 51 may angle or bevel outwardly toward the exterior support ring surface 54 from the support ring wall 47 to the inner support ring edge 52. In some embodiments, each sealing element support ring 46 may be fabricated of a suitable type of rigid drillable material including but not limited to metal, composite material and/or engineering-grade plastic. Other materials which are suitable for each sealing element support ring 46 include but are not limited to PTFE (polytetrafluoroethylene).

Figure 22:
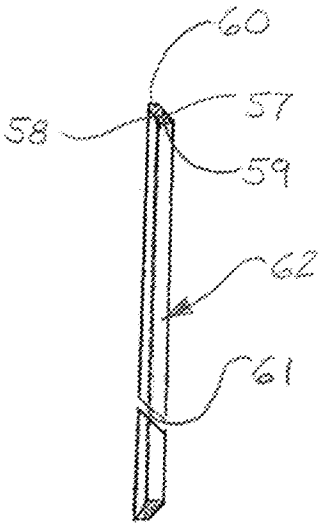
FIG. 22 is a cross-sectional view of the end element seal ring.
Figure 19:
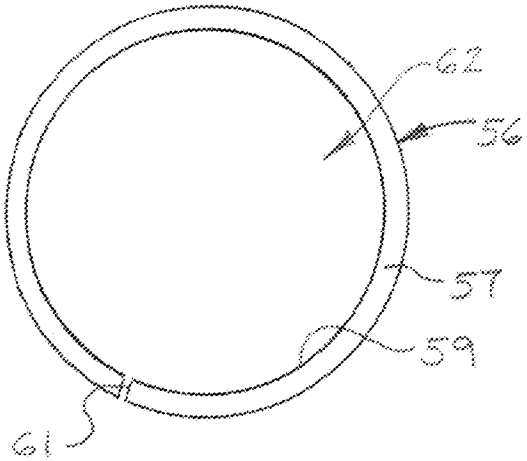
FIG. 19 is an inner view of a typical end element seal ring of the illustrative sealing element system.
Figure 21:
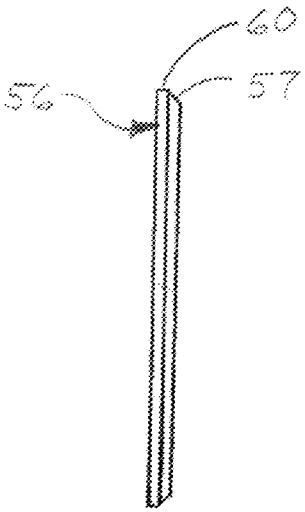
FIG. 21 is an exterior view of the end element seal ring.
Figure 23:
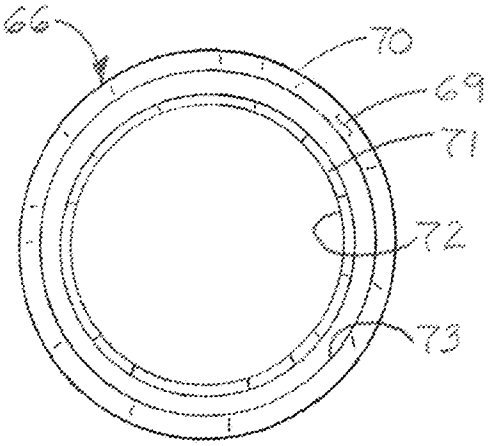
FIG. 23 is an inner view of a typical completion ring of the illustrative scaling element system.
Figure 24:
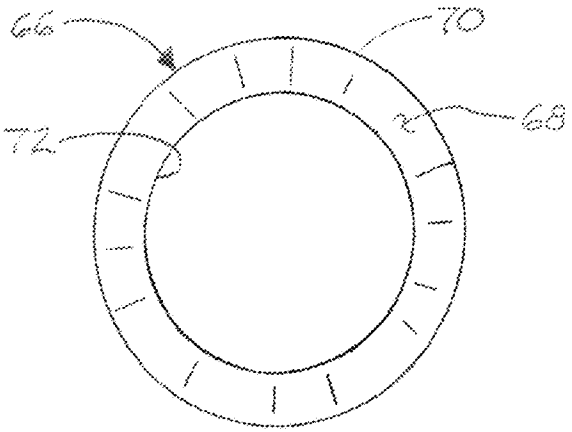
FIG. 24 is an outer view of the completion ring.

Referring next to FIGS. 19-22 of the drawings, a typical design for each end element seal ring 56 of the sealing element system 34 is illustrated. Each end element seal ring 56 may have a ring opening 62, an inner seal ring surface 57 and an outer seal ring surface 58. An interior ring surface 59 may traverse and face the ring opening 62 from the inner ring surface 57 to the outer ring surface 58. An exterior ring surface 60 may extend from the inner ring surface 57 to the outer ring surface 58. As illustrated in FIG. 22, each of the inner ring surface 57 and the outer ring surface 58 may be beveled. In some embodiments, a ring gap 61 may interrupt, the end element seal ring 56. Accordingly, in typical assembly of the sealing element system 34, each end element seal ring 56 may be suitably sized and configured to snap-fit into the end sealing element bevel 39 (FIG. 11) in the end sealing element wall 37 of the corresponding end sealing element 36 such that the ring gap 61 in the end element seal ring 56 closes. Each end element seal ring 56 may be fabricated of a suitable type of rigid drillable material including but not limited to steel, other metal, composite material and/or other suitable material.

Referring next to FIGS. 23-26 of the drawings, a typical design for each completion ring 66 of the sealing element system 34 is illustrated. The completion ring 66 may have an annular completion ring wall 67. The completion ring wall 67 may have an outer completion ring surface 68 and an inner completion ring surface 69. An exterior completion ring surface 70 may extend from the outer completion ring surface 68 to the inner completion ring surface 69.

Figure 25:
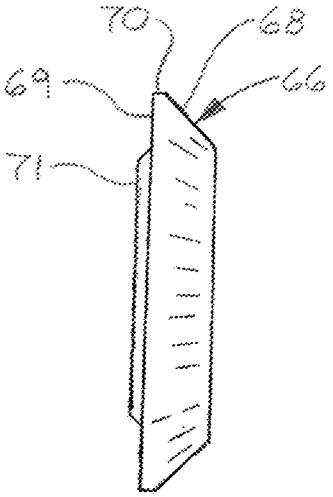
FIG. 25 is an exterior view of the completion ring.
Figure 26:
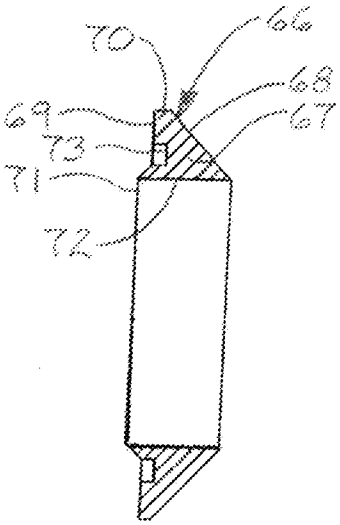
FIG. 26 is a cross-sectional view of the completion ring.

A completion ring rim 71 may protrude from the inner completion ring surface 69. A completion ring bore 72 may extend through the completion ring rim 71 and completion ring wall 67, opening to the outer completion ring surface 68. As illustrated in FIGS. 25 and 26, in some embodiments, the outer completion ring surface 68 may bevel or angle outwardly from the exterior completion ring surface 70 to the completion ring bore 72. As further illustrated in FIG. 26, an annular completion ring cavity 73 may extend into the inner completion ring surface 69 for purposes which will be hereinafter described. In some embodiments, each completion ring 66 may be fabricated of a suitable type of rigid drillable material including but not limited to steel, other metal, composite material and/or other suitable material.

Figure 28:
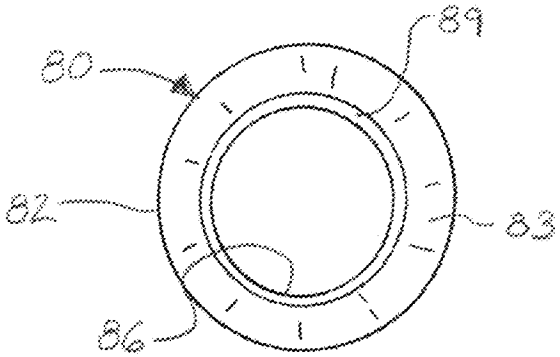
FIG. 28 is an outer end view of the lower backup ring support.
Figure 30:
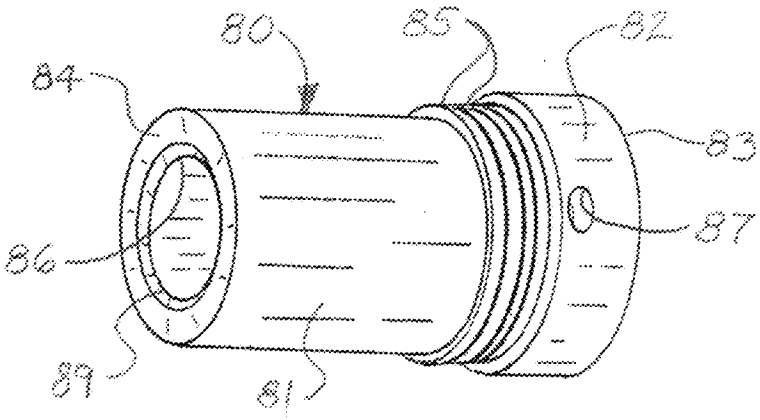
FIG. 30 is an inner end perspective view, of the lower backup ring support.
Figure 27:
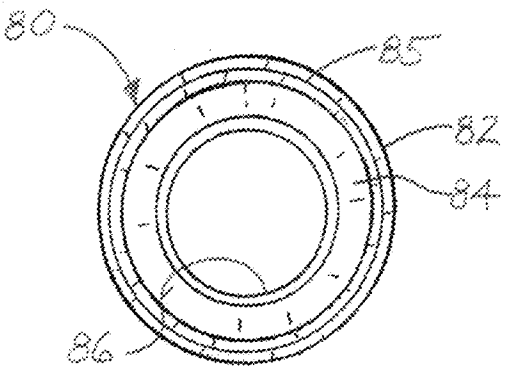
FIG. 27 is an inner end view of a typical lower backup ring support of the illustrative sealing element system.
Figure 29:
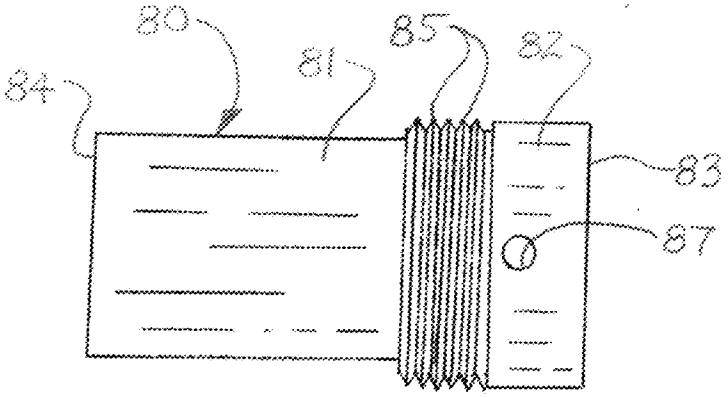
FIG. 29 is an exterior view of Ilk lower backup ring support.

Referring next to FIGS. 27-30 of the drawings, a typical design for the lower backup ring support 80 of the scaling element system 34 is illustrated. The lower backup ring, support 80 may have a lower backup ring support wall 81 which may be elongated and cylindrical. The lower backup ring support wall 81 may have an outer ring support end 83 and an inner ring support end 84. A ring support bore 86 may traverse the lower backup ring support wall 81 from the outer ring support end 83 to the inner ring support end 84. A support portion head 82 may extend circumferentially outwardly from the lower backup ring wall 81 at the outer ring support end 83 of the lower backup ring support wall 81. In some embodiments, at least one radial shear pin opening 87 may extend through the support portion head 82 in communication with the ring support bore 86. The shear pin opening 87 may be suitably sized and configured to accommodate at least one shear pin (not illustrated) for securement of the lower backup ring support 80 on the packer mandrel 2. Exterior ring support threads 85 may be provided on the lower backup ring support wall 81 typically adjacent to the support portion head 82 for purposes which will be hereinafter described. In some embodiments, the lower backup ring support 80 may be fabricated of a suitable type of rigid drillable material including but not limited to metal, composite material and/or engineering-grade plastic. As illustrated in FIGS. 28 and 30, in some embodiments, an annular beveled backup, ring surface 89 may circumscribe the ring support bore 86 at the inner ring support end 84. Materials which are suitable for the lower backup ring support 80 include but are not limited to steel, other metal, composite material and/or other suitable material.

Figure 32:
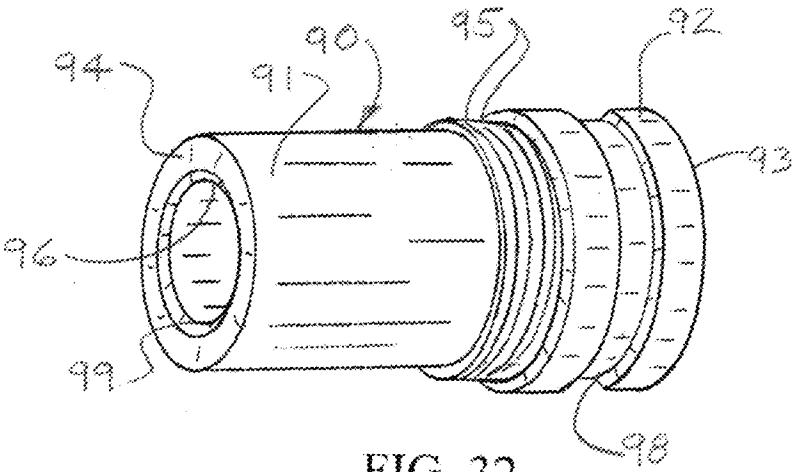
FIG. 32 is an inner end perspective view of the upper backup ring support.
Figure 34:
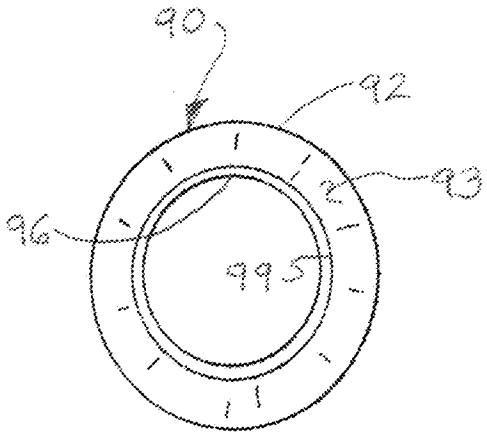
FIG. 34 is an outer end view of the upper backup ring support.
Figure 31:
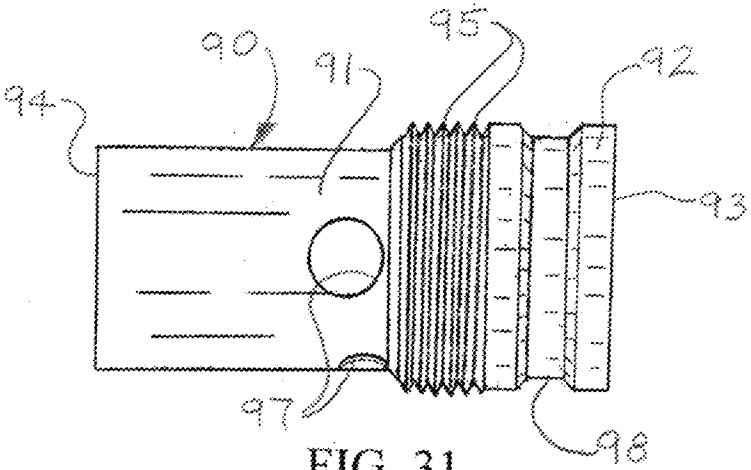
FIG. 31 is an exterior view of a typical upper backup ring support of the illustrative sealing element system.
Figure 33:
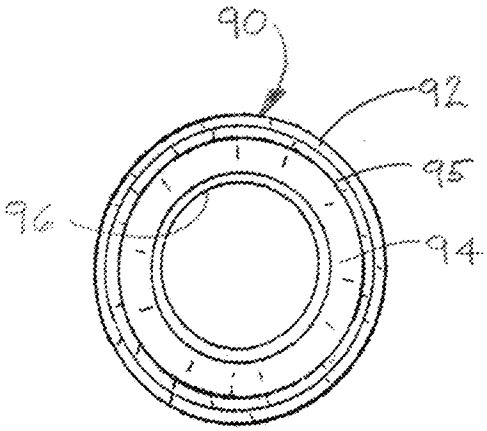
FIG. 33 is an inner end view of the upper backup ring support.
Figure 35:
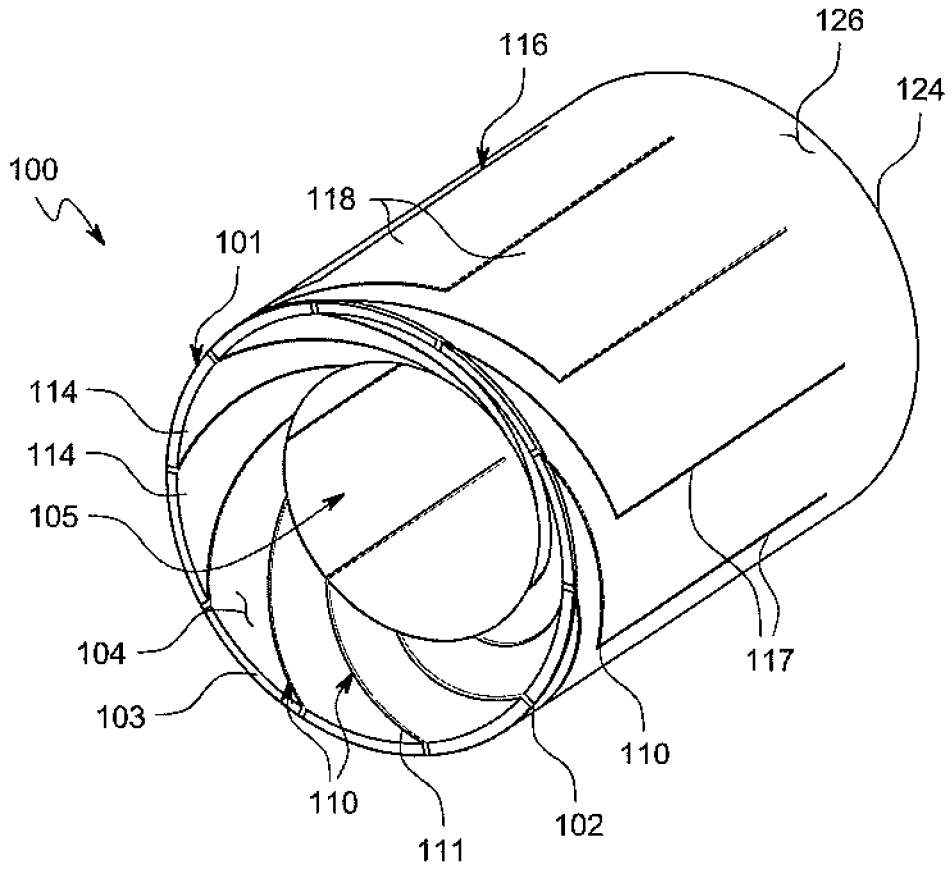
FIG. 35 is an inner end perspective view of a typical backup ring of the illustrative sealing element system.

Referring next to FIGS. 31-34 of the drawings, a typical design for the upper backup ring support 90 of the sealing element system 34 is illustrated. The upper backup ring support 90 may have an upper backup ring support wall 91 which may be elongated and cylindrical. The upper backup ring support wall 91 may have an outer ring support end 93 and an inner ring support end 94. A ring support bore 96 may traverse the upper backup ring, support wall 91 from the outer ring support end 93 to the inner ring support end 94. A support portion head 92 may extend circumferentially outwardly from the upper backup ring wall 91 at the outer ring support end 93 of the upper backup ring support wall 91. In some embodiments, at least one radial shear pin opening 97 may extend through the upper backup ring support wall 91 in communication with the ring support bore 96. The shear pin opening 97 may be suitably sized and configural to accommodate at least one shear pin (not illustrated) for securement of the upper backup ring support 90 on the packer mandrel 2. Exterior ring support threads 95 may be provided on the upper backup ring support wall 91 typically adjacent, to the support portion head 92 for purposes which will be hereinafter described. In some embodiments, at least one seal ring groove 98 may be provided in the support portion head 92 for purposes which will be hereinafter described. In some embodiments, the upper backup ring support 90 may be fabricated of a suitable type of rigid drillable material including but not limited to metal, composite material and/or engineering-grade plastic. As illustrated in FIGS. 32 and 34, in some embodiments, an annular beveled backup ring surface 99 may circumscribe the ring support bore 96 at the inner ring support end 94. Materials which are suitable for the upper backup ring support 90 include but are not limited to a suitable type of rigid drillable material including but not limited to steel, other metal, composite material and/or other suitable material.

Figure 39:
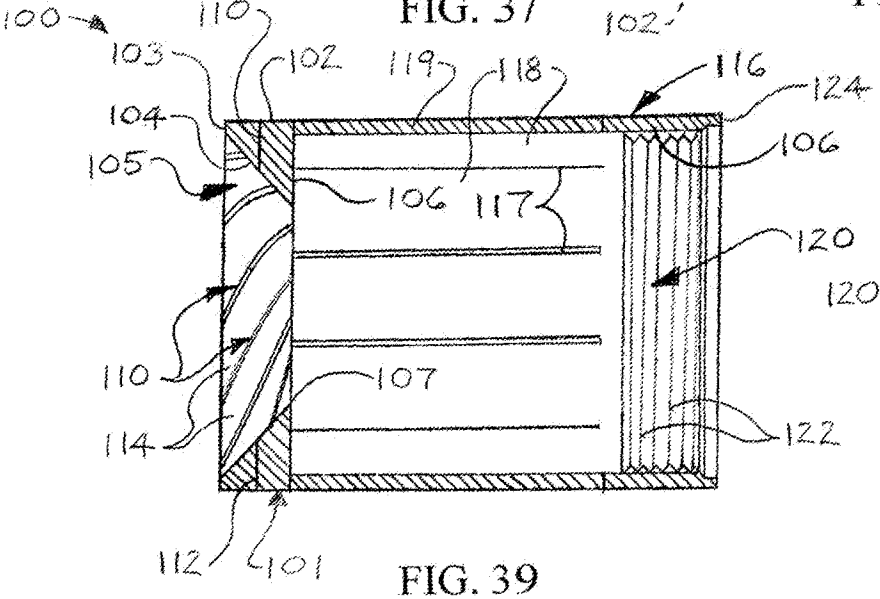
FIG. 39 is longitudinal sectional view of the backup ring in the pre-expanded configuration.

Referring next to FIGS. 35-40 of the drawings, a typical design for each backup ring 100 of the sealing element system 34 is illustrated. Each backup ring 100 may include a backup ring body 101 which may be annular. The backup ring body 101 may have an engaging ring surface 102. A ring edge surface 103 may extend from the engaging ring surface 102. A beveled ring surface 104 may extend from the ring edge surface 103. An interior ring surface 106 may extend from the beveled ring surface 104. As illustrated in FIG. 39, the interior ring surface 106 may be parallel to the ring edge surface 103. A ring opening 105 may extend through the backup ring body 101 from the ring edge surface 103 to the interior ring surface 106. Accordingly, from the ring edge surface 103 to the interior ring surface 106, the beveled ring surface 104 may angle inwardly toward the center of the ring opening 105. The interior ring surface 106 may join the beveled ring surface 104 along an interior ring edge 107 which may circumscribe the ring opening 105.

Figure 36:
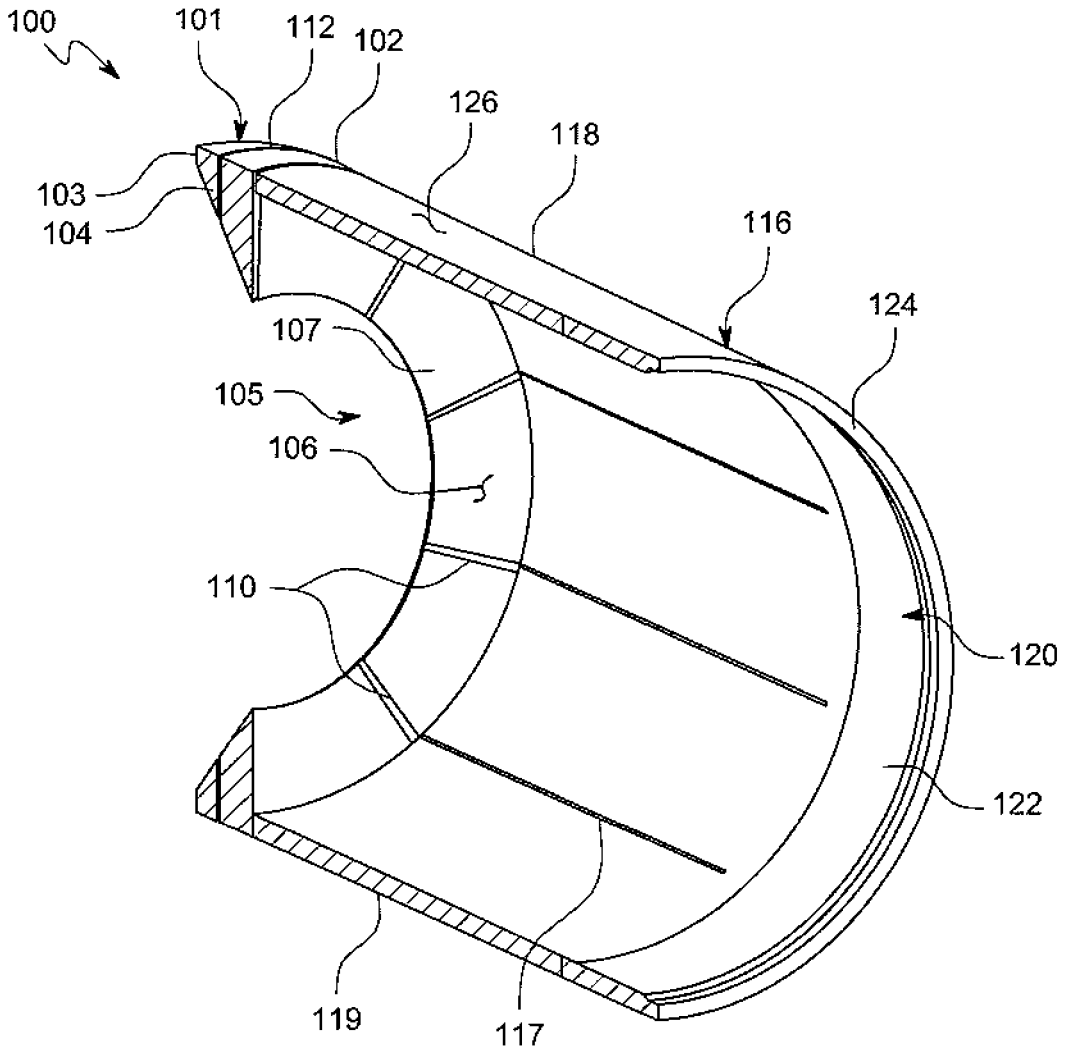
FIG. 36 is an outer end longitudinal sectioned perspective view of the backup ring.
Figure 38:
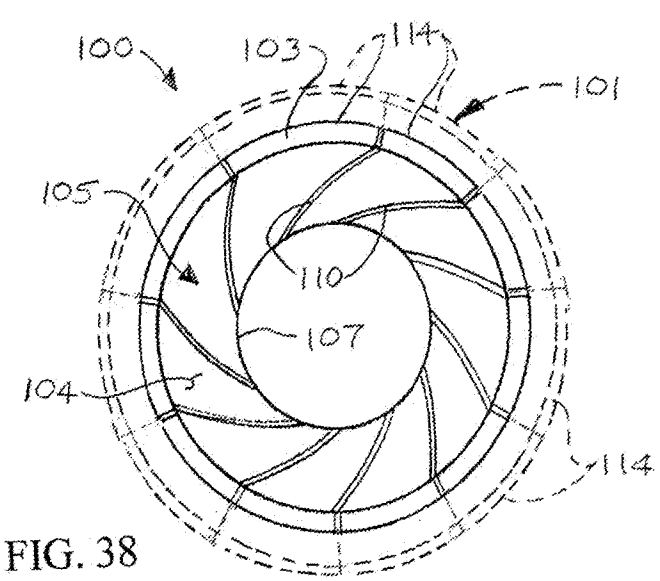
FIG. 38 is an inner end view of the backup ring, taken along viewing lines 38-38 in FIG. 37, deployed in the pre-expanded configuration (in solid lines) and the expanded configuration (in phantom lines)

A ring sleeve 116 may extend from the backup ring body 101. The ring sleeve 116 may be at least partially circumferentially-extendable and as illustrated in FIG. 39, may have a ring sleeve wall 119 which may be elongated and cylindrical. The ring sleeve wall 119 may have an exterior sleeve surface 126. In some embodiments, the outer width or diameter of the ring sleeve 116 may correspond to the outer width or diameter of the backup ring body 101. Accordingly, the exterior sleeve surface 126 of the ring sleeve 116 may be flush with the engaging ring surface 102 of the backup ring body 101. As illustrated in FIGS. 36 and 39, the ring sleeve wall 119 may form a sleeve interior 120 which communicates with the ring opening 105 of the backup ring body 101. The ring sleeve wall 119 may extend from the interior ring surface 106 of the backup ring body 101 and terminate at a sleeve edge 124 opposite the backup ring body 101.

As illustrated in FIG. 39, interior sleeve threads 122 may be provided in the ring sleeve wall 119 typically adjacent to the sleeve edge 124. The interior sleeve threads 122 may engage the corresponding exterior ring support threads 85 (FIGS. 29 and 30) on the lower backup ring support 80 and exterior ring support threads 95 (FIGS. 31 and 32) on the upper backup ring support 90 to secure the lower backup ring **100*a* and the upper backup ring 100*b* on the respective lower backup ring support 80 and upper backup ring support 90 in assembly of the sealing element system 34**, which will be hereinafter further described.

Figure 40:
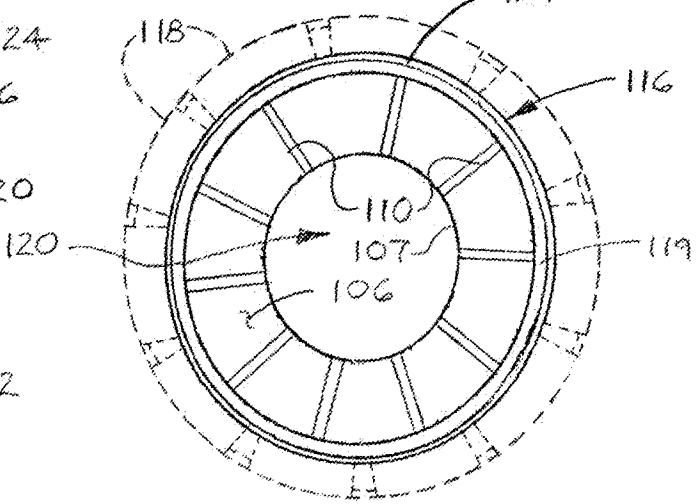
FIG. 40 is an outer end view of the backup ring, taken along viewing lines 40-40 in FIG. 37, deployed in the pre-expanded configuration tin solid lines) and the expanded configuration (in phantom lines)
Figure 37:
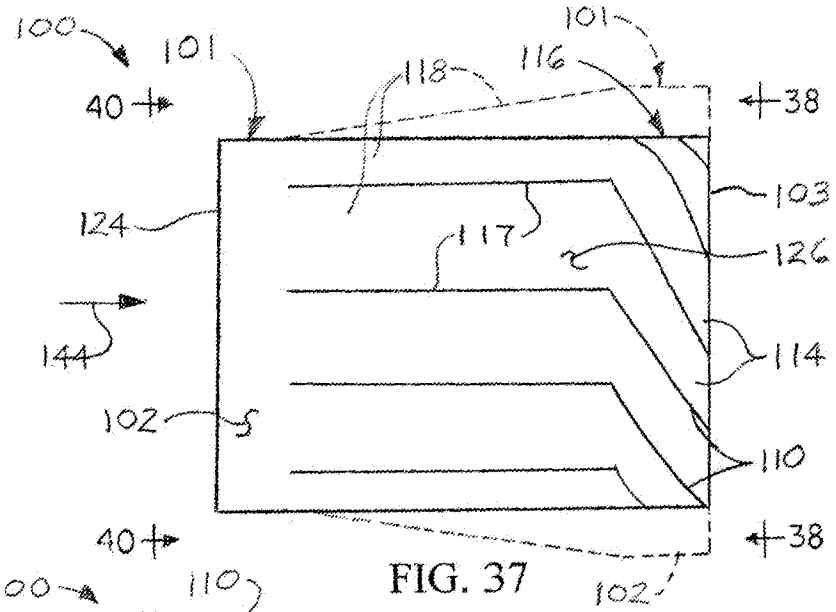
FIG. 37 is an exterior view of the backup ring, deployed in a pre-expanded configuration (in solid lines) and in, a typical expanded configuration (in phantom lines)

Multiple spiral ring slots 110 may be provided in the backup ring body 101. Each spiral ring slot 110 may traverse the backup ring body 101 along a curved or spiraled trajectory from the ring edge surface 103 to the interior ring edge 107. As illustrated in FIGS. 36 and 40, each spiral ring slot 110 may extend through the backup ring body 101 from the engaging ring surface 102 to the beveled ring surface 104. As illustrated in FIGS. 36 and 40, each spiral ring slot 110 may traverse the interior ring surface 106 from the interior ring edge 107 to the ring sleeve wall 119 of the ring sleeve 116. Accordingly, the spiral ring slots 110 may partially divide or separate the backup ring body 101 into multiple, adjacent expandable ring portions 114.

Multiple sleeve slots 117 may extend through the ring sleeve wall 119 of the ring sleeve 116. The sleeve slots 117 may communicate with the respective spiral ring slots 110 in the backup ring body 101. The sleeve slots 117 may extend in parallel, spaced-apart relationship to each other and terminate in spaced-apart relationship to the sleeve edge 124 of the ring sleeve wall 119. The sleeve slots 117 may divide or separate the ring sleeve wall 119 into a corresponding number of expandable sleeve portions 118 which may be continuous with or extend from the respective expandable ring portions 114 of the backup ring body 101. Responsive to application of an axial force 144 (FIG. 37) to the backup ring 100, typically as will be hereinafter described, the expandable ring portions 114 may circumferentially deploy and the expandable sleeve portions 118 may partially circumferentially deploy from a pre-expanded configuration illustrated by solid lines to an expanded configuration illustrated by phantom lines in FIGS. 37, 38 and 40, for purposes which will be hereinafter described.

Each backup ring 100 may be fabricated of steel, carbon fiber composite material and/or other suitable material. In some embodiments, each backup ring 100 may be fabricated of a suitable type of rigid drillable material including but not limited to metal, composite material and/or engineering-grade plastic. Materials which are suitable for each backup ring 100 include but are not limited to steel, other metal, composite material and/or other suitable material.

Figure 41:
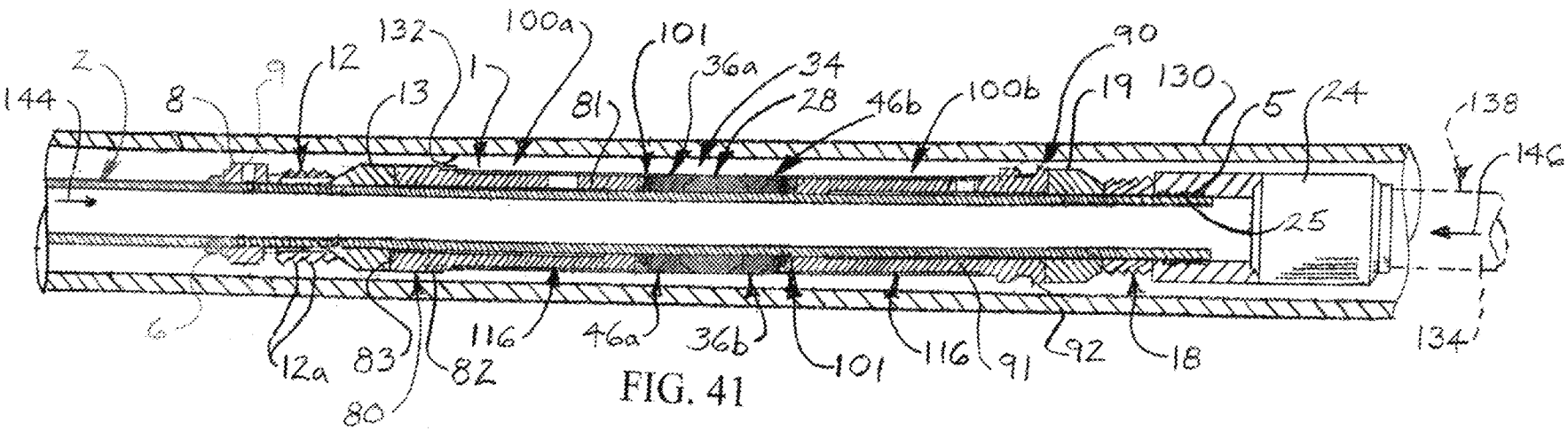
FIG. 41 is a longitudinal sectional view of a downhole bridge plug assembly assembled in a tubing string (in phantom) and deployed in a well easing, with the sealing element system assembled in the downhole bridge plug assembly, preparatory to deployment of the sealing element system from the pre-expanded configuration to the expanded configuration engaging and sealing against the well casing.
Figure 42:
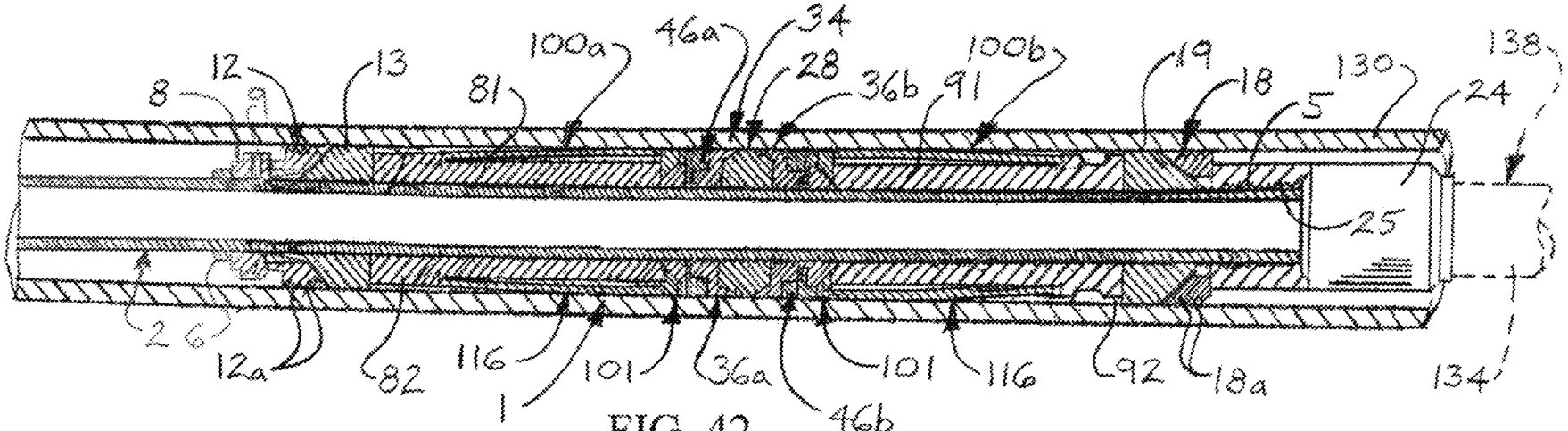
FIG. 42 is a longitudinal sectional view of the downhole bridge plug assembly illustrated in FIG. 41, with the scaling element system deployed in the expanded configuration engaging and sealing against the well casing.
Figure 43:
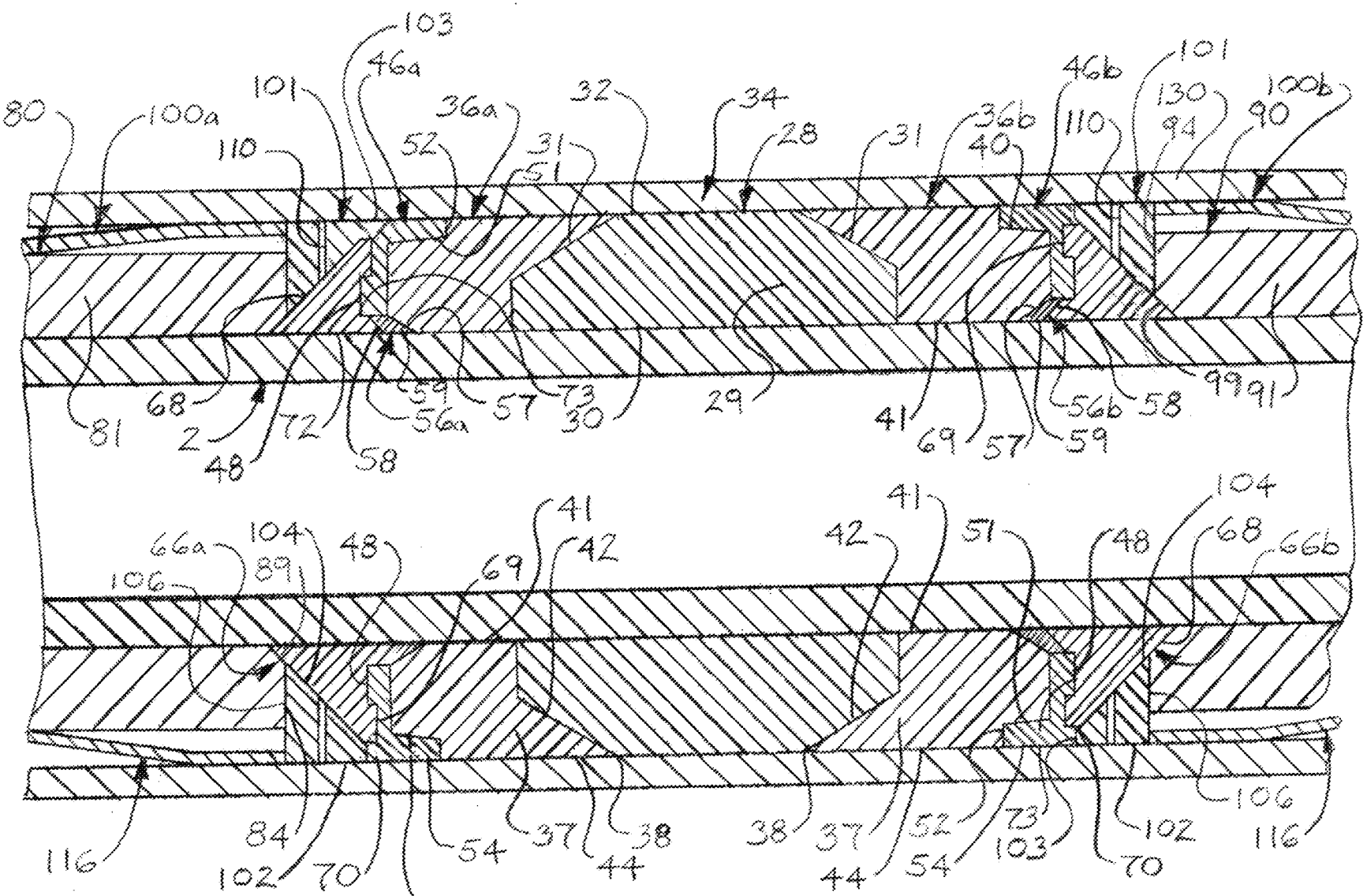
FIG. 43 is an enlarged sectional view of the expanded sealing element system engaging and sealing against the well casing.
Figure 44:
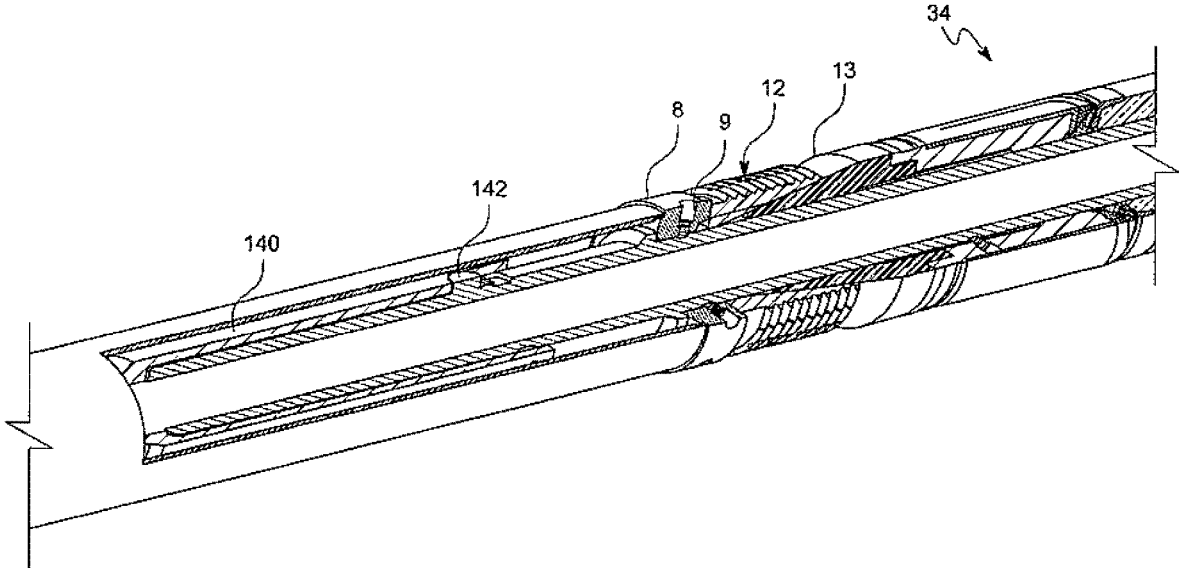
FIGS. 44 and 45 are sectioned perspective views illustrating a typical tension mandrel engaging the packer mandrel preparatory to deploying the sealing element system in the expanded configuration.
Figure 45:
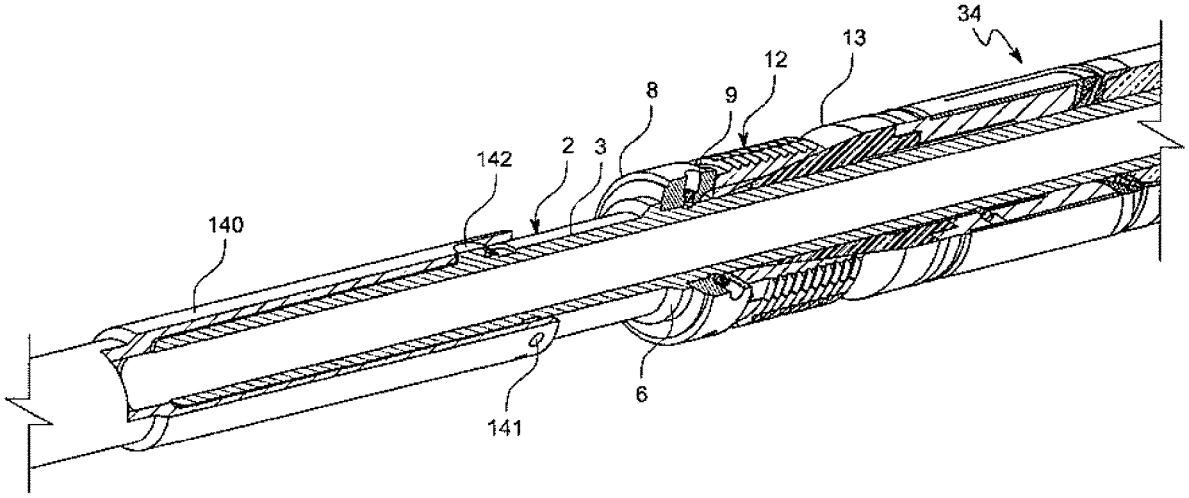

Referring next to FIGS. 41-45 of the drawings, the assembly 1 may be assembled typically by sequential placement of the components or elements of the sealing element system 34 on the packer mandrel 2. Preparatory to assembly, the lower sealing ring 100*a* may be placed on the lower backup ring support 80 typically by inserting the inner ring support end 84 (FIGS. 29 and 30) into the sleeve interior 120 (FIGS. 36 and 39) of the lower backup ring 100*a* and engaging the sleeve threads 122 in the lower backup ring 100*a* with the companion ring support threads 85 on the lower backup ring support 80. In like manner, the upper sealing ring 100*b* may be placed on the upper backup ring support 90 typically by inserting the inner ring support end 94 (FIGS. 31 and 32) into the sleeve interior 120 of the upper backup ring 100*b* and engaging the sleeve threads 122 in the upper backup ring 100*b* with the companion ring support threads 95 (FIGS. 31 and 32) on the upper backup ring support 90. As illustrated in FIG. 43, the inner ring support end 84 of the lower backup ring support 80 may engage the interior ring surface 106 of the lower backup ring 100*a*. Likewise, the inner ring support end 94 of the upper backup ring support 90 may engage the interior ring surface 106 of the upper backup ring 100*b*. The lower end element seal ring 56*a* may be snap-fitted against the end sealing element bevel 39 in the end sealing element wall 37 of the lower end sealing element 36*a*. In like manner, the upper end element seal ring 56*b* may be snap-fitted against the end scaling element bevel 39 in the end sealing element wall 37 of the upper end sealing element 36*b*.

The lower slip assembly 12 may be placed on the packer mandrel 2, after which the lower cone 13 may be placed on the packer mandrel 2 in engagement with the lower slip assembly 12. The lower backup ring support 80 with the lower backup ring 100*a* thereon may then be placed on the packer mandrel 2 typically by inserting the packer mandrel 2 through the ring support bore 86 (FIGS. 27, 28 and 30) and sliding the lower backup ring support 80 along the packer mandrel 2 until the outer ring support end 83 of the lower backup ring support 80 engages the lower cone 13. In some applications, the lower backup ring support 80 may be secured on the packer mandrel 2 by inserting at least one shear pin (not illustrated) through the at least one shear pin opening 87 (FIGS. 29 and 30) in the lower backup ring support wall 81 of the lower backup ring support 80 and into a registering shear pin opening (not illustrated) in the packer mandrel 2.

The lower completion ring 66*a* may be placed on the packer mandrel 2 typically by inserting the packer mandrel 2 through the completion ring bore 72 (FIGS. 23, 24 and 26) and sliding the lower completion ring 66*a* along the packer mandrel 2 until the beveled outer completion ring surface 68 engages the companion beveled ring surface 104 of the lower backup ring 100*a*.

The lower sealing element support ring 46*a* may next be placed on the packer mandrel 2 typically by inserting the packer mandrel 2 through the ring opening 62 (FIG. 19) of the lower end element seal ring 56*a* and sliding the lower scaling element support ring 46*a* along the packer mandrel 2 typically until the wall rim 48 inserts into the companion completion ring cavity 73 in the lower completion ring 66*a*.

The lower end sealing element 36*a*, with the lower end element seat ring 56*a* typically snap-fitted against the end sealing element bevel 39, may be placed on the packer mandrel 2 typically by inserting the packer mandrel 2 through the end sealing element bore 41 and end sealing element cavity 42 (FIGS. 10-14) and sliding the lower end sealing element 36*a* along the packer mandrel 2 typically until the end sealing element beveled portion 40 inserts into and engages the companion beveled end sealing element cavity 42 (FIG. 11) of the lower end sealing element 36*a*.

The center sealing element 28 may be placed on the packer mandrel 2 typically by inserting the packer mandrel 2 through the center sealing element bore 30 (FIGS. 6, 8 and 9) and sliding the center sealing element 28 along the packer mandrel 2 until the corresponding center sealing element beveled portion 31 inserts into and engages the companion end sealing element cavity 42 in the lower end sealing element 36*a*. The upper end sealing element 36*b*, upper end element seal ring 56*b*, upper sealing element support ring 46*b*, upper completion ring 66*b*, upper backup ring support 90 with upper, backup ring 100*b*, upper cone 19 and upper slip assembly 18 may then be sequentially placed on the packer mandrel 2 in reverse order to that which was heretofore described with respect to the lower slip assembly 12, lower cone. 13, lower backup ring support 80 with lower backup ring 100*a*, lower sealing element support ring 46*a* and lower end element seal ring 56*a*, and lower end sealing element 36*a*. In some applications, the lower elements of the sealing element system 34 may be assembled on the packer mandrel 2 before the upper elements as was heretofore described. In other applications, the various elements of the scaling element system 34 may be assembled on the packer mandrel 2 in alternative orders. For example and without limitation, the center sealing element 28 may be placed on the packer mandrel 2 first, followed by placement of the lower and upper elements on the packer mandrel 2, and finally, the lower cone 13, upper cone 19, lower slip assembly 12 and upper slip assembly 18 in alternating order until the assembly 1 is completed.

As illustrated in FIG. 41, the packer mandrel cap 8 may be pinned in place on the packer mandrel 2, in engagement with the lower slip assembly 12. The mandrel flange 6 on the packer mandrel 2 may engage the mandrel cap 8. The compression sleeve 24 may be threaded on the ratchet threads 5 of the packer mandrel 2 into engagement with the upper slip assembly 18. The compression sleeve 24 may be additionally attached to the packer mandrel 2 by extending the shear pins (not illustrated) through the respective shear pin openings 26 (FIG. 1) provided in the compression sleeve 24 and registering shear pin openings not illustrated) provided in the packer mandrel 2.

In typical application, the assembled apparatus 1 may be placed in a well casing 130 which extends into a subterranean fluid-producing well (not illustrated) such as an oil and/or gas well, for example and without limitation, between two adjacent production fractions in the well to seal the fractions from each other and prevent flow of fluid between the fractions. Accordingly, the compression sleeve 24 may be attached to an upper tubing string segment 134 of a tubing string 138 such as in the conventional manner. A lower tubing string segment 136 of the tubing string 138 may be coupled to the packer mandrel cap 8. The tubing string 138 may then be inserted in the well casing 130 with the assembly 1 installed in the tubing string 138. In some applications, the well casing 130 may be oriented in a vertical position in the well, in which case the lower slip assembly 12, the lower cone 13 and the lower elements of the sealing element system 34 may be positioned beneath the center sealing element 28, the upper elements of the sealing element system 34, the upper cone 19 and the upper slip assembly 18. In other applications, the well casing 130 may be oriented in a horizontal or diagonal position.

A tension mandrel 140 (FIG. 44), typically pinned to the packer mandrel 2 via a tension mandrel pin 141, may next be operated to pull the packer mandrel 2, the mandrel flange 8 against the packer mandrel cap 8 and the packer mandrel cap 8 against the lower slip assembly 12 as the tension mandrel pin 141 shears, applying an axial force 144 to the lower slip assembly 12, as indicated in FIG. 41. As the magnitude of the axial force 144 overcomes the shear pins connecting the components of the sealing element system 34 to the packer mandrel 2, the ratchet threads 5 on the packer mandrel 2 typically travel along the tool threads 25 of the compression sleeve 24. This action may push the lower slip assembly 12 onto the lower cone 13. Simultaneously, the compression sleeve 24 may apply an axial force 146 to and push the upper slip assembly 18 onto the upper cone 19, its further indicated in FIG. 41. Therefore, the lower cone 13 may push or expand the lower slip assembly 12 outwardly until the slip assembly ridges 12*a* of the lower slip assembly 12 engage the interior surface of the well casing 130, as illustrated in FIG. 42. In like manner, the upper cone 19 may push or expand the upper slip assembly 18 outwardly until the slip assembly ridges 18*a* of the upper slip assembly 18 engage the interior surface of the well casing 130.

The lower cone 13 and the upper cone 19 may travel along the packer mandrel 2 against the lower backup ring support 80 and the upper backup ring support 90, respectively. This action may compress the center sealing element 28, the lower end sealing element 36*a*, the upper end sealing element 36*b*, the lower backup ring 100*a* and the upper backup ring 100*b* between the lower cone 13 and the upper cone 19. Consequently, as illustrated in FIGS. 42 and 43, the center sealing element 28, the lower end sealing element 36*a* and the upper end sealing element 36*b* may circumferentially expand and engage the interior surface of the well casing 130 and form a fluid-tight seal between the assembly 1 and the well casing 130. A fluid-tight seal may likewise form between the exterior surface of the packer mandrel 2 and the interior surfaces of the center sealing element 28, the lower end sealing element 36*a* and the upper end sealing element 36*b*. The lower backup ring 100*a* and the upper backup ring 100*b* may expand outwardly and engage the interior surface of the well casing 130 and the exterior surface of the packer mandrel 2, reinforcing and preventing movement of the center sealing element 28, the lower end sealing element 36*a* and the upper end sealing element 36*b* as pressure is subsequently placed on the assembly 1 during well operations.

Referring next to FIGS. 37, 38, 40 and 43 of the drawings, in deployment of the sealing element system 34 from the pre-expanded to the expanded configuration, the lower backup ring support 80 may apply the axial force 144 to the lower backup ring 100*a* and the upper backup ring support 90 may apply the axial force 146 to the upper backup ring 100*b*. Accordingly, as illustrated in FIG. 43, the beveled ring surface 104 on the backup ring body 101 of each corresponding backup ring 100 may wedge against and ride outwardly on the beveled outer completion ring surface 68 on the corresponding completion ring 66. This action may force the expandable ring portions 114 of the backup ring body 101 circumferentially outwardly along the spiral ring slots 110 and the expandable sleeve portions 118 of the ring sleeve 116 circumferentially outwardly along the sleeve slots 117 until the engaging ring surface 102 of the backup ring body 101 engages the interior surface of the well casing 130 in a fluid-tight seal. Responsive to pressure applied by the lower backup ring 100*a* and the upper backup ring 100*b*, the respective lower sealing element support ring 46*a* and upper sealing element support ring 46*b* may expand circumferentially outwardly to engage the interior surface of the well casing 130. The expanded lower backup ring 100*a* and upper backup ring 100*b*, along with the expanded center sealing element 28, lower end sealing element 36*a*, upper end sealing element 36*b*, lower sealing element support ring 46*a* and upper sealing element support ring 46*b*, may prevent flow of well fluid in the well casing 130 past the expanded sealing element system 34. The lower sealing element support ring 46*a* and the upper sealing element support ring 46*b*, along with the backup ring body 101 of each corresponding lower backup ring 100*a* and upper backup ring 100*b*, may each form a structural barrier which constrains and prevents the respective lower end sealing element 36*a* and upper end scaling element 36*b* from expanding downwardly or upwardly along the well casing 130 beyond the sealing element system 34. The lower sealing element seal ring 56*a* and the upper sealing element seal ring 56*b*, along with the lower completion ring 66*a* and upper completion ring 66*b*, may additionally each form a structural barrier which constrains and prevents the respective lower end sealing element 36*a* and upper end sealing element 36*b* from expanding downwardly or upwardly along the packer mandrel 2 beyond the sealing element system 34. The adjacent fractions in the hydrocarbon formation on opposite sides of the sealing element system 34 may thus be fluidly sealed from each other, along both the interior surface of the well casing 130 and the exterior surface of the packer mandrel 2, for the purpose of conducting various well operations.

It will be appreciated by those skilled in the art that as the beveled ring surface 104 of each backup ring 100 is pressed against and rides outwardly on the beveled outer completion ring surface 68 of the corresponding completion ring 66, the expandable ring portions 114 and expandable sleeve portions 118 (FIGS. 37, 38 and 40) may expand outwardly along the respective spiral ring slots 110 and sleeve slots 117. Therefore, the engaging ring surface 102 of each backup ring 100 may form a tight and congruent fit against the interior surface of the well casing 130 and tightly engage the interior surface of the well casing 130, reinforcing and preventing inadvertent movement of the sealing element system 34 upon application of the axial forces 144, 146 (FIG. 41) to the assembly 1 during well operations. Simultaneously, the completion rings 66 may slide outwardly along the packer mandrel 2 as the beveled outer completion ring surface 68 of each completion ring 66 approaches the corresponding beveled backup ring surface 89 of the lower backup ring support 80 and beveled backup ring surface 99 of the upper backup ring support 90. The engaging ring surface 102 of each backup ring 100 may engage the interior surface of the well casing 130 before the beveled outer completion ring surface 68 of each completion ring 66 engages the corresponding beveled backup ring surfaces 89 of the lower backup ring support 80 and beveled backup ring surface 99 of the upper backup ring support 90. Accordingly, the assembly 1 with the expanded sealing element system 34 may seal the production fractions from each other through the well casing 130 and operations can be carried out in the well without the leakage of well fluid among the separated fractions between the apparatus 1 and the well casing 130 and between the apparatus 1 and the packer mandrel 2. In some applications, when removal of the assembly 1 from the well casing 130 is desired, a drill bit or milling cutter (not illustrated) may be inserted through the well casing 130 and operated to grind the assembly 1 into fragments according to the knowledge of those skilled in the art.

While various illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A sealing element system for a downhole bridge plug assembly, comprising:

a packer mandrel;

at least one sealing element carried by the packer mandrel;

a first completion ring carried by the packer mandrel on a first side of the at least one sealing element, the first completion ring having a first beveled outer completion ring surface;

a second completion ring carried by the packer mandrel on a second side of the at least one sealing element, the second completion ring having a second beveled outer completion ring surface;

a first backup ring support carried by the packer mandrel proximate the first completion ring;

a second backup ring support carried by the packer mandrel proximate the second completion ring;

a first backup ring carried by the first backup ring support, the first backup ring including:

a circumferentially-expandable first backup ring body; and a first ring sleeve extending from the first backup ring body, an outer width or diameter of the first ring sleeve corresponding an outer width or diameter of the first backup ring body; and a second backup ring carried by the second backup ring support, the second backup ring including:

a circumferentially-expandable second backup ring body; and a second ring sleeve extending from the second backup ring, body, an outer width or diameter of the second ring sleeve corresponding, to an outer width or diameter of the second backup ring body.

2. The sealing element system of claim 1 wherein the at least one sealing element comprises a center sealing element carried by the packer mandrel and a first end sealing element and a second end sealing element carried by the packer mandrel in engagement with the center sealing element.

3. The sealing element system of claim 1 further comprising a first sealing element support ring carried by the packer mandrel between the at least one sealing element and the first completion ring and a second sealing element support ring carried by the packer mandrel between the at least one sealing element and the second completion ring.

4. The sealing element system of claim 1 wherein each of the first ring sleeve of the first backup ring and the second ring sleeve of the second ring body is at least partially circumferentially-expandable.

5. The sealing element system of claim 1 further comprising a first plurality of spiral ring slots in the first backup ring body, a first plurality of expandable ring portions between the first plurality of spiral ring slots, a first plurality of sleeve slots in the first ring sleeve and a first plurality of expandable sleeve portions extending from the first plurality of expandable ring portions, respectively; and a second plurality of spiral ring slots in the second backup ring body, a second plurality of expandable ring portions between the second plurality of spiral ring slots, a second plurality of sleeve slots in the second ring sleeve and a second plurality of expandable sleeve portions extending from the second plurality of expandable ring portions, respectively.

6. A sealing element system for a downhole bridge plug assembly, comprising:

a packer mandrel;

at least one sealing element carried by the packer mandrel;

a first completion ring carried by the packer mandrel on a first side of the at least one sealing element, the first completion ring having a first beveled outer completion ring surface;

a second completion ring carried by the packer mandrel on a second side of the at least one sealing element, the second completion ring having a second beveled outer completion ring surface;

a first backup ring support carried by the packer mandrel proximate the first completion ring;

a second backup ring support carried by the packer mandrel proximate the second completion ring;

a first backup ring carried by the first backup ring support, the first backup ring including:

a circumferentially-expandable first backup ring body; and a first ring sleeve extending from the first backup ring body; and a second backup ring carried by the second backup ring support, the second backup ring including:

a circumferentially-expandable second backup ring body; and a second ring sleeve extending from the second backup ring body a first sealing element support ring carried by the packer mandrel between the at least one sealing element and the first completion ring;

a second sealing element support ring carried by the packer mandrel between the at least one sealing element and the second completion ring; and a first end element seal ring between the first sealing element support ring and the packer mandrel and a second end element seal ring between the second sealing element support ring and the packer mandrel.

7. A sealing element system for a downhole bridge plug assembly, comprising:

a packer mandrel;

at least one sealing element carried by the packer mandrel;

a first completion ring carried by the packer mandrel on a first side of the at least one scaling element, the first completion ring having a first beveled outer completion ring surface;

a second completion ring carried by the packer mandrel on a second side of the at least one sealing element, the second completion ring having a second beveled outer completion ring surface;

a first backup ring support carried by the packer mandrel proximate the first completion ring;

a second backup ring support carried by the packer mandrel proximate the second completion ring;

a first backup ring carried by the first backup ring support, the first backup ring including:

a circumferentially-expandable first backup ring body; and a first ring sleeve extending from the first backup ring body; and a second backup ring carried by the second backup ring support, the second backup ring including:

a circumferentially-expandable second backup ring body; and a second ring sleeve extending from the second backup ring body; and wherein the first backup ring comprises a first interior ring surface eon the first backup ring body and the second backup ring comprises a second interior ring surface on the second backup ring body, and the first backup ring support engages the first interior ring surface and the second backup ring support engages the second, interior ring surface.

8. A sealing element system for a downhole bridge plug assembly, comprising:

a packer mandrel;

at least one sealing element carried by the packer mandrel;

a first completion ring carried by the packer mandrel on a first side of the at least one sealing element, the first completion ring having a first beveled outer completion ring surface;

a second completion ring carried by the packer mandrel on a second side of the at least one sealing element, the second completion ring having a second beveled outer completion ring surface;

a first backup ring support carried by the packer mandrel proximate the first completion ring;

a second backup ring support carried by the packer mandrel proximate the second completion ring;

a first backup ring carried by the first backup ring support, the first backup ring including;

a circumferentially-expandable first backup rim body; and a first ring sleeve extending from the first backup ring, body; and a second backup ring carried by the second backup ring support, the second backup ring including:

a circumferentially-expandable second backup ring body; and a second ring sleeve extending from the second backup ring body;

a first plurality of interior sleeve threads in the first ring sleeve and a first plurality of exterior ring support threads on the first backup ring support and engaging the first plurality of sleeve threads; and a second plurality of interior sleeve threads in the second ring sleeve and a second plurality of exterior ring support threads on the second backup ring support and engaging the second plurality of sleeve threads.

9. A sealing element system for a downhole bridge plug assembly, comprising:

a packer mandrel;

a circumferentially-expandable center sealing element carried by the packer mandrel;

a circumferentially-expandable first end sealing element carried by the packer mandrel in engagement with the center sealing element;

a circumferentially-expandable second end sealing element carried by the packer mandrel in engagement with the center sealing element;

a first sealing element support ring carried by the packer mandrel in engagement with the first end sealing, element;

a second sealing element support ring carried by the packer mandrel in engagement with the second end sealing element;

a first completion ring carried by the packer mandrel in engagement with the first sealing element support ring, the first completion ring having a first beveled outer completion ring surface;

a second completion ring carried by the packer mandrel in engagement with the second sealing element support ring, the second completion ring having a second beveled outer completion ring surface;

a first backup ring support carried by the packer mandrel;

a second backup ring support carried by the packer mandrel;

a first backup ring carried by the first backup ring support, the first backup ring including:

a circumferentially-expandable first backup ring body having a first beveled ring surface in engagement with the first beveled outer completion ring surface of the first completion ring and a first interior ring surface proximate the first backup ring support; and a partially circumferentially-expandable first ring sleeve extending from the first backup ring body;

a second backup ring carried by the second backup ring support, the second backup ring including:

a circumferentially-expandable second backup ring body having a second beveled ring surface in engagement with the second beveled outer completion ring surface of the second completion ring and a second interior ring surface proximate the second backup ring support; and a partially circumferentially-expandable second ring sleeve extending from the second backup ring body; and a first end element seal ring between the first sealing element support ring and the packer mandrel and a second end element seal ring between the second sealing element support ring and the packer mandrel.

10. The sealing element system of claim 9 wherein the first sealing element support ring comprises a first support ring wall, a first wall rim extending from the first support ring wall and a first rim opening extending through the first wall rim, and the first end element seal ring is disposed in the first rim opening; and the second sealing element support ring comprises a second support ring wall, a second wall rim extending from the second support ring wall and a second rim opening extending through the second wall rim, and the second end element seal ring is disposed in the second rim opening.

11. The sealing element system of claim 9 wherein the center sealing element comprises a center sealing element wall, a cylindrical center sealing element middle portion in the center sealing element wall, a pair of first and second center sealing element beveled portions extending from the center sealing element middle portion and a center sealing element bore traversing the center sealing element middle portion and the pair of first and second center sealing element beveled portions of the center sealing element wall, and wherein the first end sealing element engages the first center sealing element beveled portion and the second end sealing element engages the second center sealing element beveled portion of the center sealing element.

12. The sealing element system of claim 11 wherein the first end sealing element comprises a first end sealing element wall having a first cylindrical end sealing element main portion and a first end sealing element beveled portion extending from the first end sealing element main portion, and the first end sealing element main portion engages the first center sealing element beveled portion of the center sealing element and the first sealing element support ring engages the first end sealing element beveled portion of the first end sealing element; and the second end sealing element comprises a second end sealing element wall having a second cylindrical end sealing element main portion and a second end sealing element beveled portion extending from the second end sealing element main portion, and the second end sealing element main portion engages the second center sealing element beveled portion of the center sealing element and the second sealing element support ring engages the second end sealing element beveled portion of the second end sealing element.

13. The sealing element system of claim 12 wherein the first sealing element support ring comprises a first support ring wall, a first wall rim extending from the first support ring wall, a first rim opening extending through the first wall rim, a first support ring extension extending from the first support ring wall and a first beveled support ring interior in the first support ring extension, and wherein the first end element seal ring is disposed in the first rim opening, the first beveled support ring interior engages the first end scaling element beveled portion of the first end sealing element and the first completion ring engages the first support ring wall; and the second sealing element support ring comprises a second support ring wall, a second wall rim extending from the second support ring wall, a second rim opening extending through the second wall rim, a second support ring extension extending from the second support ring wall and a second beveled support ring interior in the second support ring extension, and wherein the second end element seal ring is disposed in the second rim opening, the second beveled support ring interior engages the second end sealing element beveled portion of the second end sealing, element and the second completion ring engages the second support ring wall.

14. The sealing element system of claim 13 wherein the first completion ring comprises a first completion ring wall having a first inner completion ring surface engaging the first support ring wall of the first sealing element support ring, the first beveled outer completion ring surface opposite the first inner completion ring surface; and the second completion ring comprises a second completion ring wall having a second inner completion ring surface engaging the second support ring wall of the second sealing element support ring, the second beveled outer completion ring surface opposite the second inner completion ring surface.

15. A sealing element system for a downhole bridge plug assembly, comprising:

a packer mandrel;

a circumferentially-expandable center sealing element carried by the packer mandrel;

a circumferentially-expandable first end sealing element carried by the packer mandrel in engagement with the center sealing element;

a circumferentially-expandable second end sealing element carried by the packer mandrel in engagement with the center sealing element;

a first sealing element support ring carried by the packer mandrel in engagement with the first end sealing element;

a second sealing element support ring carried by the packer mandrel in engagement with the second end sealing element;

a first completion ring carried by the packer mandrel in engagement with the first sealing element support ring, the first completion ring having a first beveled outer completion ring surface;

a second completion ring carried by the packer mandrel in engagement with the second sealing element support ring, the second completion ring having a second beveled outer completion ring surface;

a first backup ring support carried by the packer mandrel;

a second backup ring support carried by the packer mandrel;

a first backup ring carried by the first backup ring support, the first backup ring including:

a circumferentially-expandable first backup ring body having a first beveled ring surface in engagement with the first beveled outer completion ring surface of the first completion ring and a first interior ring surface proximate the first backup ring support; and a partially circumferentially-expandable first ring sleeve extending from the first backup ring body; and a second backup ring carried by the second backup ring support, the second backup ring including:

a circumferentially-expandable second backup ring body having a second beveled ring surface in engagement with the second beveled outer completion ring surface of the second completion ring and a second interior ring surface proximate second backup ring support; and a partially circumferentially-expandable second ring sleeve extending from the second backup ring body; and a first plurality of spiral ring slots in the first backup ring body, a first plurality of expandable ring portions between the first plurality of spiral ring slots, a first plurality of sleeve slots in the first ring sleeve and a first plurality of expandable sleeve portions extending from the first plurality of expandable ring portions, respectively; and a second plurality of spiral ring slots in the second backup ring body, a second plurality of expandable ring portions between the second plurality of spiral ring slots, a second plurality of sleeve slots in the second ring sleeve and a second plurality of expandable sleeve portions extending from the second plurality of expandable ring portions, respectively.

16. A sealing element system for a downhole bridge plug assembly, comprising:

a packer mandrel;

a circumferentially-expandable center sealing element carried by the packer mandrel;

a circumferentially-expandable first end sealing element carried by the packer mandrel in engagement with the center sealing element;

a circumferentially-expandable second end sealing element carried by the packer mandrel in engagement with the center sealing element;

a first seating element support ring carried by the packer mandrel in engagement with the first end sealing element;

a second sealing element support ring carried by the packer mandrel engagement with the second end sealing element;

a first completion ring carried by the packer mandrel in engagement with the first sealing element support ring, the first completion ring having a first beveled outer completion ring surface;

a second completion ring carried by the packer mandrel in engagement with the second sealing element support ring, the second completion ring having a second beveled outer completion ring surface;

a first backup ring support carried by the packer mandrel;

a second backup ring support carried by the packer mandrel;

a first backup ring carried by the first backup ring support, the first backup ring including:

a circumferentially-expandable first backup ring body having a first beveled ring surface in engagement with the first beveled outer completion ring surface of the first completion ring and a first interior ring surface proximate the first backup ring support; and a partially circumferentially-expandable first ring sleeve extending from the first backup ring body; and a second backup ring carried by the second backup ring support, the second backup ring including:

a circumferentially-expandable second backup ring body having a second beveled, ring surface in engagement with the second beveled outer completion ring surface of the second completion ring and a second interior ring surface proximate the second backup ring support; and a partially circumferentially-expandable second ring sleeve extending from the second backup ring body; and a first plurality of interior sleeve threads in the first ring sleeve and a first plurality of exterior ring support threads on the first backup ring support and engaging the first plurality of sleeve threads, and a second plurality of interior sleeve threads in the second ring sleeve and a second plurality of exterior ring support threads on the second backup ring support and engaging the second plurality of sleeve threads.

* * * * *